US010767916B2

(12) United States Patent
Tansley

(10) Patent No.: US 10,767,916 B2
(45) Date of Patent: Sep. 8, 2020

(54) FLUID RESERVOIR REFRIGERATION APPARATUS

(71) Applicant: The Sure Chill Company Limited, Tywyn (GB)

(72) Inventor: Ian Tansley, Tywyn (GB)

(73) Assignee: The Sure Chill Company Limited, Cardiff (GB)

( * ) Notice: Subject to any disclaimer, the term of this patent is extended or adjusted under 35 U.S.C. 154(b) by 518 days.

(21) Appl. No.: 14/373,580

(22) PCT Filed: Jan. 28, 2013

(86) PCT No.: PCT/GB2013/050184

§ 371 (c)(1),
(2) Date: Jul. 21, 2014

(87) PCT Pub. No.: WO2013/110957

PCT Pub. Date: Aug. 1, 2013

(65) Prior Publication Data

US 2014/0360214 A1 Dec. 11, 2014

(30) Foreign Application Priority Data

Jan. 27, 2012 (GB) ..... 1201437.9
Jan. 17, 2013 (GB) ..... 1300885.9
Jan. 17, 2013 (GB) ..... 1300886.7

(51) Int. Cl.
*F25D 11/00* (2006.01)
*F25D 17/02* (2006.01)

(52) U.S. Cl.
CPC ..... *F25D 11/00* (2013.01); *F25D 11/003* (2013.01); *F25D 11/006* (2013.01); *F25D 17/02* (2013.01);

(Continued)

(58) Field of Classification Search
CPC .. F25D 11/006; F25D 17/02; F25D 2302/082; F25D 2303/0821
See application file for complete search history.

(56) References Cited

U.S. PATENT DOCUMENTS 186,200 A 1/1877 Crisfield
1,402,602 A * 1/1922 Hansen ..... F25D 31/002 220/DIG. 8

(Continued)

FOREIGN PATENT DOCUMENTS

CN 2062629 U 9/1990
CN 2162269 Y 4/1994

(Continued)

OTHER PUBLICATIONS

Examination Report dated Jan. 5, 2017 in Egyptian Patent Application No. 2012010066, with English translation, 7 pages.

(Continued)

*Primary Examiner* — Nelson J Nieves
(74) *Attorney, Agent, or Firm* — Perkins Coie LLP

(57) ABSTRACT

An apparatus for cooling objects such as food items, beverages or vaccines comprises at least two reservoirs, a cooling device for cooling fluid contained in one of the reservoirs and a thermal transfer region between respective upper regions of the reservoirs. The thermal transfer region permits thermal transfer between the fluid contained in the reservoirs such that cooling of the fluid in one reservoir causes cooling of the fluid in the other reservoir.

15 Claims, 12 Drawing Sheets

(52) U.S. Cl.
CPC .... *F25D 2303/085* (2013.01); *F25D 2400/32* (2013.01)

(56) References Cited

U.S. PATENT DOCUMENTS 1,594,015 A 7/1926 McLaughlin
1,885,837 A * 11/1932 Beks ..... A47F 3/0404 62/448
1,951,496 A * 3/1934 Stevens ..... F25D 11/006 62/115
1,982,570 A * 11/1934 Cann ..... F25D 17/02 165/104.31
1,988,549 A 1/1935 Gibson
2,046,967 A 7/1936 Post et al.
2,130,790 A * 9/1938 Dick ..... F25D 31/003 62/180
2,138,885 A * 12/1938 Ross ..... F25D 11/006 220/592.25
2,495,878 A * 1/1950 Tull ..... F25D 31/003 62/188
2,641,109 A 6/1953 Muffly
2,973,630 A * 3/1961 Kriechbaum ..... F25D 21/02 374/160
2,975,610 A * 3/1961 Olson ..... F25D 21/02 62/139
3,049,890 A * 8/1962 Ruppel ..... A23B 4/066 62/240
3,609,991 A 10/1971 Chu et al.
3,721,104 A * 3/1973 Adler ..... B63J 2/12 62/240
4,065,336 A 12/1977 Conklin
4,498,312 A 2/1985 Schlosser
4,509,587 A 4/1985 Clark et al.
4,715,195 A 12/1987 Kucza
4,958,506 A 9/1990 Guilhem et al.
5,035,122 A 7/1991 Oogjen
5,129,238 A 7/1992 Schwartz et al.
5,237,835 A * 8/1993 Brochier ..... F25D 17/02 62/336
5,379,596 A 1/1995 Grayson
5,408,845 A 4/1995 Clarke et al.
5,627,310 A * 5/1997 Johnson ..... G01N 29/036 62/138
5,782,095 A 7/1998 Chen
5,875,599 A 3/1999 McGrath
6,119,462 A * 9/2000 Busick ..... B67D 1/0869 62/3.3
6,314,751 B1 11/2001 Gjersvik
6,367,268 B1 * 4/2002 Paul ..... B60H 1/3235 62/330
6,415,624 B1 7/2002 Connors et al.
6,469,487 B2 10/2002 Ewert et al.
6,681,594 B1 * 1/2004 Nelson ..... B67D 1/0864 62/389
6,698,210 B2 3/2004 Ogura et al.
6,845,627 B1 * 1/2005 Buck ..... B64D 11/04 165/919
7,055,575 B2 6/2006 Noel
7,543,455 B1 6/2009 Chen
8,215,125 B2 7/2012 Linder
8,424,335 B2 4/2013 Corder et al.
8,516,849 B2 8/2013 Mooijer et al.
8,640,487 B2 2/2014 Chapa
8,943,846 B1 * 2/2015 Hartley ..... G05D 23/20 62/157
9,618,253 B2 4/2017 Tansley
9,644,882 B2 5/2017 Tansley
9,909,799 B2 3/2018 Tansley
2002/0050147 A1 5/2002 Mai et al.
2002/0104318 A1 8/2002 Jaafar et al.
2003/0070436 A1 4/2003 Wood et al.
2004/0123620 A1 7/2004 Porter
2005/0229626 A1 10/2005 Akopyan
2006/0174648 A1 8/2006 Lantz
2006/0230778 A1 10/2006 Williams
2006/0248918 A1 * 11/2006 Kellogg ..... F25B 43/00 62/194
2006/0277939 A1 * 12/2006 Robertson ..... A47F 3/0439 62/457.5
2007/0095091 A1 * 5/2007 Cyr ..... B67D 1/0857 62/398
2008/0060374 A1 3/2008 Gammons et al.
2008/0092559 A1 4/2008 Williams et al.
2008/0135564 A1 6/2008 Romero
2008/0141875 A1 6/2008 Fahrenback
2009/0151368 A1 6/2009 Bar
2010/0018221 A1 1/2010 Flinner et al.
2010/0102057 A1 4/2010 Long et al.
2010/0293970 A1 11/2010 Mooijer et al.
2010/0319386 A1 12/2010 Linder
2011/0067852 A1 * 3/2011 Farrar ..... B65D 88/745 165/263
2011/0120151 A1 5/2011 Cutting et al.
2012/0102994 A1 5/2012 Tansley
2012/0266627 A1 * 10/2012 Lee ..... F25D 17/02 62/452
2013/0000334 A1 * 1/2013 Kim ..... F25D 31/003 62/129
2016/0018151 A1 1/2016 Tansley
2016/0152402 A1 6/2016 Su
2016/0216023 A1 7/2016 Tansley et al.
2016/0243000 A1 8/2016 Gray
2017/0082344 A1 3/2017 Tansley

FOREIGN PATENT DOCUMENTS

CN 1097505 A 1/1995
CN 1133631 A 10/1996
CN 2379760 Y 5/2000
CN 1836137 A 9/2006
CN 1893863 A 1/2007
CN 201451827 U 5/2010
CN 201457996 U 5/2010
CN 103988144 A 8/2014
CN 104364592 A 2/2015
DE 240333 A1 10/1986
DE 36 27 201 A1 4/1987
DE 41 42 842 A1 4/1993
DE 44 25 213 A1 1/1996
EP 0 038 864 11/1981
EP 0 491 671 A1 6/1992
EP 491671 A1 6/1992
EP 505208 A2 9/1992
EP 1293738 A1 3/2003
EP 1 538 409 A2 6/2005
EP 1421323 B1 3/2008
FR 2537712 A1 6/1984
FR 2 562 218 10/1985
GB 165684 7/1921
GB 165684 A 7/1921
GB 494531 10/1938
GB 494531 A 10/1938
GB 1 429 678 A 3/1976
GB 2 235 968 A 3/1991
GB 2 281 773 A 3/1995
GB 2 430 724 A 4/2007
GB 2 457 054 A 8/2009
GB 2 471 865 A 1/2011
GB 2503191 A 12/2013
JP S55-190886 A 7/1982
JP S57112682 U 7/1982
JP 58-199268 A 11/1983
JP S63-243673 A 10/1988
JP H02-117067 A 5/1990
JP H04-025338 B2 4/1992
JP H05-003573 A 1/1993
JP 1993079741 A 3/1993
JP H0579741 A 3/1993
JP H08-136108 A 5/1996
JP H08-313141 A 11/1996
JP H08313141 A 11/1996
JP 10-144361 A 5/1998

(56) References Cited

FOREIGN PATENT DOCUMENTS

| | | | |
|---|---|---|---|
| JP | H11-238530 | A | 8/1999 |
| JP | 2001133109 | A | 5/2001 |
| JP | 2001221553 | A | 8/2001 |
| JP | 2001227847 | A | 8/2001 |
| JP | 2002013855 | A | 1/2002 |
| JP | 2003148849 | A | 5/2003 |
| JP | 2003254567 | A | 9/2003 |
| JP | 2004043020 | A | 2/2004 |
| JP | 48-027260 | B2 | 11/2011 |
| JP | 2012-002496 | | 1/2012 |
| JP | 2012002496 | A | 1/2012 |
| JP | 49-036282 | B2 | 5/2012 |
| SU | 898226 | A1 | 1/1982 |
| WO | 2002018210 | A1 | 3/2002 |
| WO | 2006103084 | A1 | 10/2006 |
| WO | 2009005008 | A1 | 1/2009 |
| WO | WO 2009/072876 | A1 | 6/2009 |
| WO | WO 2010/086167 | A1 | 8/2010 |
| WO | 2011007162 | A2 | 1/2011 |
| WO | 2013089678 | A1 | 6/2013 |
| WO | 2013091913 | A1 | 6/2013 |
| WO | 2013110957 | A2 | 8/2013 |
| WO | 2017039437 | A1 | 3/2017 |

OTHER PUBLICATIONS

Examination Report dated Feb. 21, 2017 in Canadian Application No. 2,767,864, 3 pages.
Examination Report dated Oct. 19, 2016 in European Patent Application No. 10739675.6, 5 pages.
Final Office Action dated Feb. 5, 2016 in U.S. Appl. No. 13/383,118 of Tansley, I. filed Jan. 9, 2012.
First Office Action dated Nov. 28, 2016 in Chinese Patent Application No. 201510186465.5, with English translation, 20 pages.
International Search Report and Written Opinion PCT/US16/51273 dated Jan. 26, 2017, pp. 1-10.
Non-Final Office Action dated Aug. 3, 2016, for U.S. Appl. No. 15/003,386 of Tansley, Ian filed Jan. 21, 2016.
Non-Final Office Action dated May 12, 2016 in U.S. Appl. No. 13/383,118 of Tansley, I. filed Jan. 9, 2012.
Notice of Allowance dated Dec. 2, 2016 in U.S. Appl. No. 13/383,118 of Tansley, Ian filed Jan. 9, 2012.
Notice of Allowance dated Jan. 30, 2017 in U.S. Appl. No. 15/003,386 of Tansley, I. filed Jan. 21, 2016.
Second Office Action dated Dec. 21, 2016 in Eurasian Patent Application No. 201491428/31, with English translation, 3 pages.
U.S. Appl. No. 15/262,486 of Tansley, I. filed Sep. 12, 2016.
Colombian Examination Report for Colombian Application No. 14-163243 with International filing date of Jan. 28, 2013; dated Jul. 14, 2015.
Colombian Examination Report for Colombian Application No. 15-202569 with International filing date of Jan. 28, 2014; dated Sep. 9, 2016.
Exam Report for Egyptian Application EG2012010066 filed Dec. 1, 2012; 7 pages.
Exam Report for Egyptian Application EG2014071169, dated Aug. 1, 2016; 7 pages.
Examination Report for Canadian Application No. 2,767,864, dated May 13, 2016, 4 pages.
Examination Report for United Kingdom Patent Application No. GB1201437.9, dated Apr. 7, 2014, 2 pages.
Final Office Action dated Aug. 29, 2016, for U.S. Appl. No. 13/383,118, of Tansley, Ian filed Jan. 9, 2012.
Final Office Action dated Nov. 5, 2014, for U.S. Appl. No. 13/383,118, of Tansley, Ian filed Jan. 9, 2012.
First Office Action dated Apr. 21, 2016, for Eurasian Patent Application No. 201491428, 5 pages.
First Office Action dated Dec. 26, 2014, for Eurasian Patent Application No. 201270161.
First Office Action dated Jun. 2, 2015, for Japanese Patent Application No. 2012-520097.
First Office Action dated Mar. 25, 2015, for Vietnamese Patent Application No. 1-2012-00156.
First Office Action dated Nov. 12, 2014, for Mexican Patent Application No. MX/A/2012/000719.
First Office Action dated Nov. 6, 2015 for Chinese Patent Application No. 201380017447.3, 66 pages, with English Translation.
First Office Action dated Sep. 5, 2014, for Phillipines Patent Application No. 12012500102.
Great Britain Examination Report for GB Application 1401455.9; dated Sep. 15, 2014.
International Search Report and Written Opinion dated Apr. 4, 2011, for International Patent Application No. PCT/GB2010/051129 filed Jul. 9, 2010.
International Search Report and Written Opinion dated May 6, 2015, for International Patent Application No. PCT/GB2014/050218 filed Jan. 28, 2014.
International Search Report and Written Opinion dated Sep. 26, 2014, for International Patent Application No. PCT/GB2014/052255 filed Jul. 23, 2014.
Non-Final Office Action dated Aug. 3, 2016, for U.S. Appl. No. 13/383,118, of Tansley, Ian filed Jan. 9, 2012.
Non-Final Office Action dated Jul. 14, 2015, for U.S. Appl. No. 13/383,118, of Tansley, Ian filed Jan. 9, 2012.
Non-Final Office Action dated Mar. 12, 2014, for U.S. Appl. No. 13/383,118, of Tansley, Ian filed Jan. 9, 2012.
Office Action in Eurasian Patent Application No. 201591385/31, dated Aug. 30, 2016, 6 pages.
Office Action in Thailand Patent Application No. 1401004332, dated May 28, 2015, 1 page.
Patent Examination Report No. 1 for Australian Application No. 2015202391, dated May 2, 2016, 3 pages.
Restriction Requirement Action dated May 16, 2016, for U.S. Appl. No. 15/003,386 of Tansley, Ian filed Jan. 21, 2016.
Restriction Requirement dated Dec. 31, 2013, for U.S. Appl. No. 13/383,118, of Tansley, Ian filed Jan. 9, 2012.
Second Office Action dated Apr. 3, 2015, for Eurasian Patent Application No. 201270161.
Second Office Action dated Aug. 26, 2016 for Chinese Patent Application No. 201380017447.3, 37 pages, with English Translation.
Second Office Action dated Aug. 4, 2015, for Japanese Patent Application No. 2012-520097.
Second Office Action dated Jul. 1, 2015, for Mexican Patent Application No. MX/A/2012/000719.
Second Office Action dated Jun. 1, 2015, for Phillipines Patent Application No. 12012500102.
Substantive Search and Examination Report dated May 11, 2014, for ARIPO Application No. AP/P/2012/006111 filed Sep. 7, 2010, 32 pages.
Substantive Search and Examination Report dated May 11, 2014, for ARIPO Application No. AP/P/2014/007819 filed Jan. 28, 2013, 4 pages.
Third Office Action dated Mar. 28, 2016, for Eurasian Patent Application No. 201270161, 4 pages.
U.S. Appl. No. 15/003,386 of Tansley, Ian filed Jan. 21, 2016.
First Office Action dated Jun. 27, 2017 in Chinese Patent Application No. 201480052383.5, with English translation, 29 pages.
Non-Final Office Action dated Jan. 31, 2017 in U.S. Appl. No. 15/262,486 of Tansley, I. filed Sep. 12, 2016.
Non-Final Office Action dated May 16, 2017 for U.S. Appl. No. 14/767,904 of Tansley, Ian, filed Aug. 13, 2015.
Notice of Allowance dated Nov. 1, 2017 for U.S. Appl. No. 14/767,904 of Tansley, Ian filed Aug. 13, 2015.
Office Action for Brazil Application No. PI1015971-1, dated Oct. 10, 2017, 1 page.
Second Office Action dated Aug. 11, 2017 in Chinese Patent Application No. 201510186465.5, with English translation, 17 pages.
Third Office Action dated Aug. 30, 2017 in Eurasian Patent Application No. 201491428/31, with English translation, 4 pages.

(56) References Cited

OTHER PUBLICATIONS

Office Action in Japanese Patent Application No. 2015-236753 with English translation, dated Apr. 11, 2017, 10 pages.
Final Office Action dated Aug. 16, 2017 in U.S. Appl. No. 15/262,486 of Tansley, Ian, filed Sep. 12, 2016.
Search and Examination Report in United Kingdom Patent Application No. GB1413094.2, dated Jan. 23, 2015, 5 pages.
Examiner's Office Action dated Apr. 7, 2017 in Philippines Patent Application No. 1-2014-501668.
Examination Report dated Mar. 24, 2017 in European Patent Application No. 13705226.2, 4 pages.
International Search Report and Written Opinion PCT/GB13/50184 dated Oct. 2, 2013, pp. 1-9.
Notice of Preliminary Rejection in Korean Patent Application No. 10-2012-7000384, dated Oct. 20, 2016, with English Translation, 35 pages.
Office Action in Japanese Patent Application No. 2015-236753 with English translation, dated Oct. 25, 2016, 14 pages.
Office Action in Japanese Patent Application No. 2014-553809 with English Translation, dated Jan. 4, 2017, 21 pages.
Second Office Action dated Dec. 3, 2014 in Philippine Patent Application No. 1/2012/500102, 3 pages.
Second Office Action dated Nov. 12, 2014 in Mexican Patent Application No. MX/a/2012/000719, with English translation, 7 pages.
Substantive Search and Examination Report dated Aug. 4, 2016 in ARIPO Application No. AP/P/2014/007819, 4 pages.
Substantive Search and Examination Report dated Nov. 5, 2014 in ARIPO Application No. AP/P/2012/006111, 32 pages.
Third Office Action issued Feb. 23, 2017 in Chinese Patent Application No. 201380017447.3, with English translation, 33 pages.
Third Office Action dated Jul. 1, 2015 in Mexican Patent Application No. MX/a/2012/000719, with English translation, 4 pages.
Third Office Action dated Jun. 1, 2015 in Philippine Patent Application No. 1/2012/500102, 1 page.
Restriction Requirement dated Jan. 4, 2017 in U.S. Appl. No. 14/373,580 of Tansley, Ian filed Jul. 21, 2014.
Subsequent Substantive Examination Report dated Feb. 15, 2018 for Philippines Patent Application No. 1-2014-501668, 7 pages.
First Examination Report dated Feb. 1, 2018 for Indian Patent Application No. 10304/DELNP/2011 filed Jul. 9, 2010, 6 pages.
Non-Final Office Action dated Dec. 20, 2017 in U.S. Appl. No. 15/262,486 of Tansley, Ian filed Sep. 12, 2016.
Notification to Grant Patent Right for Invention dated Nov. 6, 2017 for Chinese Patent Application No. 201380017447.3, 4 pages.
Notice for Granting Patent dated Sep. 5, 2017 for Korean Patent Application No. 10-2012-7000384, 6 pages.
Second Office Action dated May 28, 2018, in Chinese Patent Application No. 201480052383.5, 22 pages.
Third Office Action dated Apr. 19, 2018 in Chinese Patent Application No. 201510186465.5, 8 pages.
Examination Report for U.K. Application No. GB1415033.8; dated Oct. 30, 2018; 5 pages.
Final Substantive Examination Report Restriction dated Nov. 26, 2018, for Philippines Patent Application No. 1-2014-501668, 2 pages.
Notification to Grant Patent Right for Invention for Chinese Application No. 201510186465.5; dated Sep. 5, 2018; 4 pages.
Office Action for Indonesian Patent Application No. P-00201404548; dated Aug. 24, 2018; 3 pages.
Notice of Allowance for Indonesian Patent Application No. P-00201404548; dated Dec. 13, 2018; 3 pages.
Office Action in Brazilian Application No. PI1015971-1; dated—Sep. 4, 2019 (8 pages).
Office Action in India Application No. 7235/DELNP/2015; dated—Aug. 22, 2019 for (7 pages).
Office Action in Vietnamese Application No. 1-2014-02788; dated—Jul. 1, 2019 (1 page).
Examination Report for Indian Application No. 6047/DELNP/2014; dated Mar. 29, 2019; with English translation, 8 pages.
Extended European Search Report for European Application No. 16845259.7; dated Apr. 3, 2019; 8 pages.
Notice of Preliminary Rejection for Korean Application No. 10-2014-7023087; dated Feb. 6, 2019; 15 pages.
Office Action in Mexican Application No. MX/a/2014/009028; dated Apr. 15, 2019, with English translation, 3 pages.
European Examination Report dated Nov. 6, 2019 for European Patent Application No. 13705226.2 (5 pages).
Notification of Reason for Refusal dated Dec. 18, 2019 for Korean Application No. 10-2014-7023087 (4 pages).
First Office Action dated Nov. 28, 2019 of Chinese Patent Application No. 201680066195.7 (13 pages).
Office Action dated Nov. 11, 2019 of Mexican Application No. MX/a/2014/009028 (4pages).
Applicant-Initiated Interview Summary dated Jan. 27, 2020 of U.S. Appl. No. 14/373,580 by Tansley, T., filed Jul. 21, 2014.
Brazilian Office Action of Application No. BR112014018324.4 dated Mar. 3, 2020 (8 pages).
Final Office Action dated Dec. 27, 2019 of U.S. Appl. No. 14/373,580 by Tansley, T., filed Jul. 21, 2014.
Office Action from Philippines Application No. 1-2014-501668 dated Dec. 5, 2018 (5 pages).
Office Action in Mexican Application No. MX/a/2014/009028; dated Apr. 15, 2019; 5 pages.
Second Notice of Preliminary Rejection dated Dec. 18, 2019 for Korean Application No. 10-2014-7023087 (3 pages).
Vietnamese Office Action dated Jul. 31, 2019 for Application No. 1-2014-02788, 3 pages.
Notice of Allowance for U.S. Appl. No. 15/262,486 dated Mar. 18, 2020.
Office Action in Mexican Application No. MX/a/2014/009028; dated Nov. 11, 2019; 4 pages.

* cited by examiner

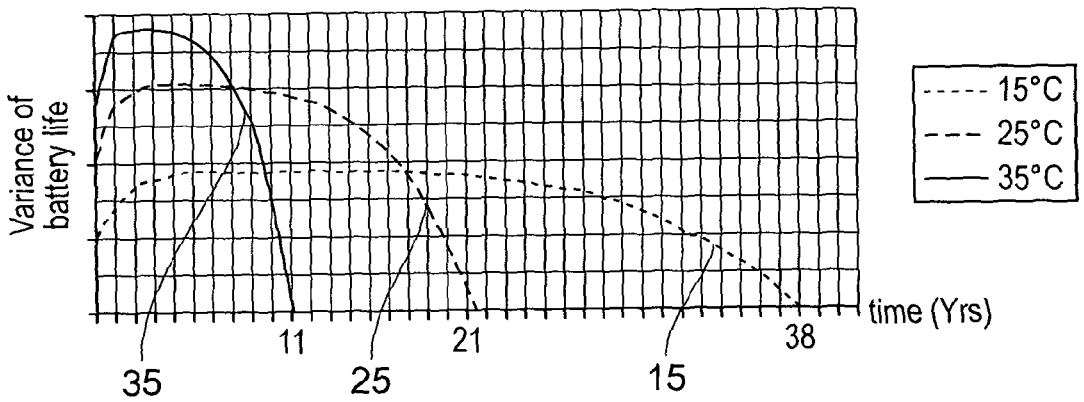
FIG. 17
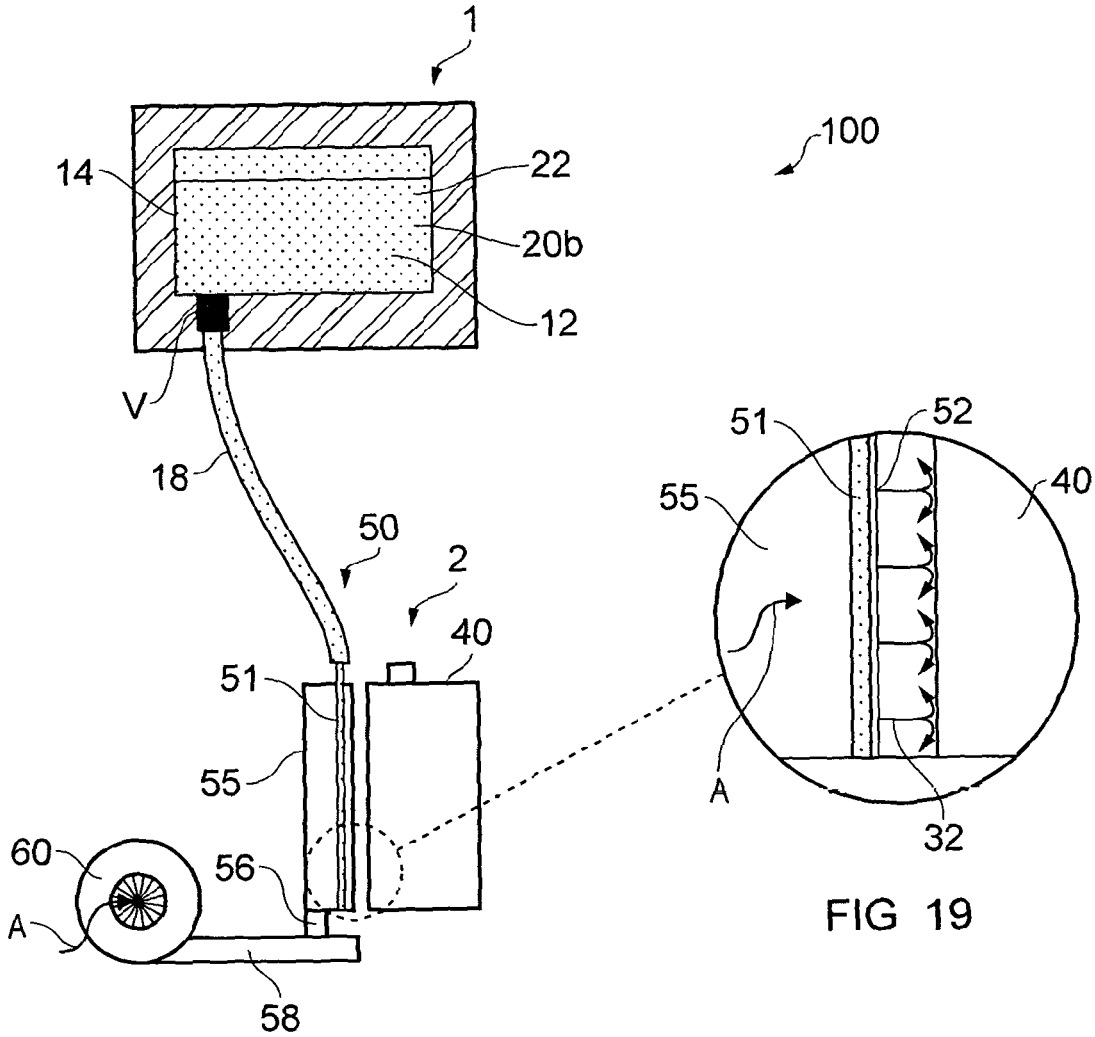
FIG 19
FIG. 18

FLUID RESERVOIR REFRIGERATION APPARATUS

RELATED APPLICATIONS

This application is a 35 U.S.C. § 371 national stage application of PCT Application No. PCT/GB2013/050184, filed on Jan. 28, 2013, which claims priority from Great Britain Patent Application No. 1201437.9, filed Jan. 27, 2012, Great Britain Patent Application No. 1300885.9, filed Jan. 17, 2013, and Great Britain Patent Application No. 1300886.7, filed Jan. 17, 2013, the contents of which are incorporated herein by reference in their entireties. The above-referenced PCT International Application was published in the English language as International Publication No. WO 2013/110957 A2 on Aug. 1, 2013.

FIELD OF THE INVENTION

The present invention relates to a refrigeration apparatus. In particularly, but not exclusively, the invention relates to a refrigeration apparatus for use in storing and transporting vaccines, perishable food items, packaged beverages or the like, and for the cooling or temperature control of equipment such as batteries, in the absence of a reliable supply of electricity. Aspects of the invention relate to an apparatus and to a method.

BACKGROUND

A large proportion of the world's population does not have access to a consistent and reliable supply of mains electricity. Underdeveloped countries, or regions remote from populated areas, frequently suffer from rationing of electrical power, often implemented by means of "load shedding", being the creation of intentional power outages, or failures of the distribution network.

The storage of vaccines, food items and beverages at appropriate temperatures is difficult in such areas where this absence of a constant and/or reliable supply of electrical power restricts the widespread use of conventional refrigeration equipment. Vaccines, for example, are required to be stored within a narrow temperature range between approximately 2-8° C., outside of which their viability can be compromised or destroyed. Similar problems arise in connection with the storage of food, particularly perishable food items, and packaged beverages such as canned or bottled drinks.

In response to this problem, the present applicants have previously proposed a form of refrigeration apparatus, disclosed in international patent application no. PCT/GB2010/051129, which permits a refrigerated storage space to be maintained within a temperature range of 4-8° C. for up to 30 days following a loss of electrical power. This prior art apparatus comprises a payload space for vaccines, food items, drinks containers or any other item to be cooled, the payload space being disposed at a lower region of a thermally insulated reservoir of water. Above the reservoir, and in fluid communication therewith, a water-filled head space containing a cooling element or low-temperature thermal mass, provides a supply of cold water to the reservoir.

This prior art apparatus relies upon the known property that water is at its maximum density at approximately 4° C. Thus, water cooled to this temperature by the cooling element or thermal mass in the head space tends to sink down into the reservoir, settling at the lower region surrounding the payload space which, through thermal transfer, is cooled to a temperature at or close to 4° C.

The applicants have identified a need to improve on the above mentioned apparatus to facilitate packaging, transportation and efficiency in some applications. It is against this background that the present invention has been conceived. Other aims and advantages of the invention will become apparent from the following description, claims and drawings.

STATEMENT OF INVENTION

Aspects of the invention therefore provide an apparatus and a method as claimed in the appended claims.

According to another aspect of the invention for which protection is sought, there is provided an apparatus comprising at least first and second fluid reservoirs, cooling means for cooling fluid contained in the first fluid reservoir, and a thermal transfer region disposed between respective upper regions of the first and second fluid reservoirs for permitting thermal transfer between the fluid contained in the first fluid reservoir and fluid contained in the second fluid reservoir.

According to a further aspect of the invention for which protection is sought, there is provided an apparatus comprising:

first and second fluid reservoirs;

cooling means for cooling fluid contained in the first fluid reservoir; and a thermal transfer region disposed between respective upper regions of the first and second fluid reservoirs, the apparatus being configured to allow fluid within the first fluid reservoir at a temperature below a critical temperature of fluid in the first reservoir to rise to an upper region of the first fluid reservoir and to allow fluid within the second fluid reservoir at a temperature above a critical temperature of fluid in the second reservoir to rise to an upper region of the second fluid reservoir thereby to allow thermal transfer to take place in the thermal transfer region between fluid that has risen in the first reservoir and fluid that has risen in the second reservoir, the apparatus being further configured to permit fluid at the critical temperature in the thermal transfer region to sink at least into the second fluid reservoir.

According to a further aspect of the invention for which protection is sought, there is provided an apparatus comprising:

first and second fluid reservoirs; and a thermal transfer region disposed between respective upper regions of the first and second fluid reservoirs, the apparatus being configured to permit cooling means to be disposed in thermal communication with fluid in the headspace thereby to cool said fluid, in use, the apparatus being configured to allow fluid within the first fluid reservoir at a temperature below a critical temperature of fluid in the first reservoir to rise to an upper region of the first fluid reservoir and to allow fluid within the second fluid reservoir at a temperature above a critical temperature of fluid in the second reservoir to rise to an upper region of the second fluid reservoir thereby to allow thermal transfer to take place in the thermal transfer region between fluid that has risen in the first reservoir and fluid that has risen in the second reservoir, the apparatus being further configured to permit fluid at the critical temperature in the thermal transfer region to sink at least into the second fluid reservoir.

It is to be understood that by critical temperature is meant a temperature at which a maxima in fluid density as a function of temperature is observed. Thus, the density of the fluid increases as its temperature rises towards the critical temperature and then decreases as the temperature rises above the critical temperature, meaning that its density is at its maximum at the critical temperature. The first and second fluid reservoirs may contain substantially the same type of fluid (e.g. water, a particular water/salt mix, or any other type of fluid having a critical temperature as defined above.

Advantageously the critical temperature is in the range from −100° C. to +50° C., further advantageously in the range from −50° C. to 10° C., still further advantageously in the range from −20° C. to around 8° C., advantageously in the range from −20° C. to 5° C., further advantageously in the range from −5° C. to 5° C. Other values are also useful.

Thus, the first and second fluid reservoirs are arranged, in use, to contain a fluid having a negative temperature coefficient of thermal expansion below the critical temperature and a positive temperature coefficient of thermal expansion above the critical temperature. In other words, the density of the fluid increases as its temperature rises towards the critical temperature and then decreases as the temperature rises above the critical temperature, meaning that its density is at its maximum at the critical temperature.

In an alternative embodiment, only the first fluid reservoir contains a fluid having a critical temperature.

The apparatus may comprise the cooling means, optionally an electrically powered cooling means. The cooling means may comprise a body of a solidified fluid such as a body of water ice. The body of solidified fluid may be contained within a sealed package, such as an icepack. The cooling means may comprise a heat exchanger through which a coolant flows, such as a refrigerant, to cool the fluid in the first reservoir, for example in the manner of chiller where a coiled tube is immersed in the fluid to cool the fluid by flow of cooled refrigerant gas of liquid therethrough. The coolant may be cooled liquid, for example cold water.

It is to be understood that reference to the thermal transfer region being disposed 'between' respective upper regions of the first and second fluid reservoirs does not mean that the thermal transfer region does not extend into the upper regions of the first and second fluid reservoirs, but includes the situation where the thermal transfer region extends from an upper region of the first fluid reservoir to the upper region of the second fluid reservoir. It is to be understood that in a number of embodiments the thermal transfer region does extend from the upper region of the first fluid reservoir to the upper region of the second fluid reservoir.

In an embodiment, the first and second fluid reservoirs are disposed in a side by side configuration.

The fluids contained in the first and second fluid reservoirs may be the same or different and may have the same or different critical temperatures. The fluid may comprise water or a fluid having similar thermal properties to water.

In an embodiment, the first and second fluid reservoirs are defined, at least in part, by a container having weir means dividing the container into said first and second fluid reservoirs. The weir means may take the form of a wall or other structure extending into the volume of the container with the first and second fluid reservoirs being defined by the respective volumes on either side thereof. The weir means may be formed from a material having a low thermal conductivity or an insulating material.

In some alternative embodiments, the weir means may be formed to have a relatively high thermal conductivity. For example the weir means may be formed from a material of relatively high thermal conductivity such as a metal, a metal coated plastics material, and/or a relatively thin material such as a relatively thin plastics material. This feature allows thermal transport between fluids in the first and second reservoirs through the weir means. This feature may permit more rapid cooling of fluid in the second fluid reservoir when cooling of fluid in the first reservoir is initially commenced.

In an embodiment, the weir means extends upwardly from a lower wall of the container towards an upper wall of the container. In an embodiment, a free end of the weir means is spaced from the upper wall of the container. The region above or adjacent to the free end of the weir means may define said thermal transfer region. The spacing between the free end of the weir means and the upper wall may be adjustable whereby the thermal transfer region may be made smaller or larger. This feature may facilitate control of a temperature of fluid in the second fluid reservoir.

In an embodiment, a lower end of the weir means may be spaced apart from the lower wall of the container such that fluid may pass from one reservoir to the other. Again, the spacing may be adjustable in some embodiments.

Alternatively or in addition, the weir means may extend between upper and lower walls of the container and include one or more apertures or slots in an upper region thereof. The region at or adjacent to the one or more apertures or slots in the weir means may define said thermal transfer region. A size or number of the one or more apertures or slots may be adjustable in some embodiments thereby to allow control of the temperature of fluid in the second reservoir.

By extend between is meant that the weir means is disposed between the upper and lower walls, and may touch or be spaced apart from the upper and/or lower wall. Thus the weir means may touch the upper wall but not the lower wall, or the weir means may touch the lower wall and not the upper wall. The weir means may be arranged to touch both upper and lower walls. Alternatively the weir means may be spaced apart from the upper and lower walls. Similarly, the weir means may touch or be spaced apart from one or both walls disposed laterally with respect to the weir means (i.e. to the side rather than above or below). Other arrangements are also useful.

Optionally, one or more apertures or slots may be provided in a lower region of the weir means such that fluid may pass from one reservoir to the other. A size or number of the one or more apertures or slots may be adjustable in some embodiments.

The thermal transfer region may define a mixing region for permitting mixing of fluids from the first and second fluid reservoirs. Alternatively, or in addition, the thermal transfer region may define a thermal flow path for permitting the flow of heat between fluids contained in the respective first and second fluid reservoirs.

In an embodiment, the first and second fluid reservoirs are in fluid communication via said thermal transfer region. The thermal transfer region may thus be arranged to permit fluid to be transferred between the first and second fluid reservoirs.

In an embodiment, the apparatus is arranged to cool the fluid in the first fluid reservoir to a temperature below its critical temperature thereby to cool fluid in the second fluid reservoir via the thermal transfer region.

Alternatively, the fluid reservoirs are in fluid isolation from one another. In this embodiment, a fluid-tight, thermally conducting barrier may be disposed between the upper regions of the fluid reservoirs. The region at or adjacent to the thermally conducting barrier may thus define said thermal transfer region.

In an embodiment, a fluid-tight, thermally conducting barrier may be disposed between the lower regions of the fluid reservoirs to permit flow of thermal energy between the reservoirs in a lower region thereof. This feature has the advantage that it can enable the second fluid reservoir to remain at lower temperatures for longer periods under certain circumstances.

For example in the case that a source of cooling of fluid in the first reservoir such as an electrical refrigeration device ceases to operate, for example due to an absence of power, liquid in the first reservoir that is at a temperature around the critical temperature may sink towards the bottom of the first reservoir. In the case that the first and second reservoirs are in thermal communication in the lower regions thereof, this fluid may absorb thermal energy from fluid in the second reservoir. In the case that the first and second reservoirs are in fluid communication in the lower regions thereof, fluid in one or both reservoirs may pass from one reservoir into the other, for example cooler fluid in the first reservoir may pass into the second reservoir. A net result is that fluid in the second reservoir may remain cooler for longer periods of time in the event of a power failure. Similarly, in the case that the first fluid reservoir is cooled by passive means rather than active means, such as by introduction of an ice pack or the like, when ice in the ice pack has melted the fluid in the second reservoir may remain cooler for longer.

The cooling means may be arranged to cool fluid in a region of the first fluid reservoir that is below the upper region thereof to a temperature below the critical temperature such that fluid in the first fluid reservoir that is cooled below the critical temperature rises in the first fluid reservoir towards the upper region. Alternatively, or in addition, fluid at a temperature on either side of the critical temperature may be displaced towards the upper region by fluid at the critical temperature.

In an embodiment, fluid at a temperature below the critical temperature displaced to the upper region of the first fluid reservoir in use mixes with fluid at a temperature above the critical temperature. In an embodiment, fluid at the upper region of the second fluid reservoir is cooled towards the critical temperature. Fluid in this mixing region at the critical temperature may therefore sink into a lower region of the second fluid reservoir.

The arrangement may be such that fluid in the second fluid reservoir may be maintained at a substantially constant temperature, at or around the critical temperature, for extended periods of time.

The cooling means may include a refrigeration unit that can cool fluid within the first fluid reservoir, and a power supply unit that can act as a source of power for the refrigeration unit. The power supply may comprise a solar power supply, such as a plurality of photovoltaic cells, for converting sunlight into electrical power. Alternatively, or in addition, a mains power supply may be used.

In typical embodiments, the refrigeration unit includes an electrically-powered compressor. However, refrigeration units using other refrigeration technology might be used to increase the electrical efficiency of the refrigerator. One example of such alternative technology is a Stirling engine cooler, which may be operated in solar direct drive mode.

The apparatus may comprise a sensor disposed to detect the formation of solidified fluid, optionally ice in the first fluid reservoir. The sensor may be a temperature sensor.

The sensor may comprise a temperature sensor for detecting when liquid in the first reservoir that is in thermal communication with the sensor has fallen below a prescribed value.

The sensor may be operative to cause operation of the refrigeration unit to be interrupted upon detection of the formation of ice, and/or when a temperature of the sensor falls below a prescribed value. The sensor may be disposed a sufficient distance from a cooling portion of the refrigeration unit to allow a sufficiently large volume of fluid to be cooled by the cooling means to a sufficiently low temperature before interrupting operation of the refrigeration unit.

Thus, in embodiments in which the cooling means is arranged to freeze fluid in the first reservoir to form a solid, for example in the form of ice, the sensor may be disposed a sufficient distance from a cooling portion of the cooling means to allow a sufficiently large frozen body to form. It is to be understood that in the case of some fluids, such as in the case where water is employed as the major constituent of fluid in the first reservoir, a temperature of the fluid as a function of distance from a frozen body of the fluid may increase relatively rapidly. Accordingly, when a temperature sensor senses a temperature of around the freezing point of the fluid, it may be assumed in some embodiments that the body of frozen fluid has grown to substantially contact the temperature sensor. Thus, temperature measurement can be an effective method of detecting formation of frozen fluid such as ice.

Methods of detecting formation of a frozen body other than thermal measurements are also useful. For example, interference of frozen fluid with a mechanical device such as a rotating vane may be a useful means for detection of frozen fluid in some embodiments. Furthermore, a change in volume of the fluid (including frozen fluid) within the first and/or second reservoir may be a useful measure of the presence of frozen fluid, for example an increase in the volume that exceeds a prescribed amount may indicate that a sufficiently large volume of frozen fluid has been formed.

In embodiments in which solidification of fluid does not take place below the critical temperature in the operation range of the apparatus, the temperature sensor may be arranged to detect when a volume of fluid below a certain temperature has grown sufficiently large substantially to contact the temperature sensor, at which point operation of the cooling means may be interrupted.

It is to be understood that once the temperature detected by the sensor has risen above the set value, operation of the refrigeration unit may be resumed. A suitable time delay for example due to hysteresis in the control system may be introduced to prevent switching on and off of the cooling means at too high a frequency.

As discussed above in some alternative embodiments of the invention, the cooling means may include a thermal mass that, for use and at least initially, is at a temperature below a target temperature of the payload space. This can provide a refrigerator that is simple in construction and that has no moving parts in operation. For example, the thermal mass may be a body of water ice. Such an arrangement may be used on its own (i.e. without a refrigeration unit) or in combination with a refrigeration unit. In some arrangements, cooling means having a combination of a thermal mass supplied from a source external to the refrigerator and in addition a refrigeration unit can cool the refrigerator to its working temperature more quickly than can the refrigeration unit alone.

Such embodiments may include a compartment for receiving the thermal mass in thermal communication with fluid such as water in the first fluid reservoir. For example, the compartment may be suitable for receiving ice, either in loose form or provided within a container such as an ice pack. The compartment may be suitable for receiving a different coolant such as solidified carbon dioxide ('dry ice') or any other suitable coolant. Alternatively, the thermal mass may be immersed in fluid within the first fluid reservoir. In this latter case, the thermal mass may be coolant in loose form or packaged form, such as an ice pack.

According to another aspect of the present invention for which protection is sought, there is provided a refrigeration apparatus comprising an apparatus according to the previous aspect and a payload volume for containing an object or item to be cooled disposed in thermal communication with the second fluid reservoir.

In an embodiment, the payload volume may comprise one or more shelves for supporting items or objects to be cooled. The payload volume may be open fronted. Alternatively, the payload volume may comprise a closure such as a door for thermal insulation thereof.

Alternatively or in addition, the apparatus may comprise at least one receptacle within which an article such as a container such as a beverage container, a fruit or any other suitable article can be placed for temperature-controlled storage.

The or each receptacle may comprise a tube or pouch having an opening defined by an aperture disposed in a wall of the reservoir and extending inwardly into the cooling region so as to be submerged therein.

The or each tube or pouch may be closed at its end distal from the opening.

The or each receptacle may be formed from a flexible material, optionally a resilient flexible material such as an elastomeric material.

The or each receptacle may taper from its end proximal to the opening towards its end distal to the opening. Alternatively each receptacle may be untapered, with substantially parallel walls, for example a cylindrical tube of substantially constant diameter along at least a portion of a length thereof, optionally substantially the entire length thereof.

The apparatus may comprise at least two receptacles, the end of each receptacle distal to its respective opening being connected.

The or each receptacle may be arranged to permit transfer of heat from an article held therein to fluid contained in the cooling region.

The apparatus may comprise one or more fluid pipelines through which a fluid to be cooled flows, in use. The pipeline may be arranged to flow through the second reservoir. Alternatively or in addition the pipeline may be arranged to flow through the first reservoir. The pipeline may be a pipeline for a beverage dispensing apparatus. The apparatus may be configured whereby beverage to be dispensed is passed through the pipeline, optionally by means of a pump and/or under gravity.

In an embodiment, the payload volume may be arranged to contain one or more articles such as one or more batteries.

The apparatus may comprise a heat exchanger portion arranged to be fed with fluid from the second fluid reservoir.

The apparatus may comprise means for passing air over or through the heat exchanger portion towards, onto or around the article.

The means for passing air may comprise a fan or compressor in fluid communication with the heat exchanger portion via a ducting.

The heat exchanger portion may be disposed within a housing in fluid communication with the ducting, the housing comprising one or more apertures therein through which air passing over or through the heat exchanger portion is expelled from the housing towards, onto or around the article.

The housing may comprise a plurality of apertures, optionally apertures of relatively small diameter compared with a surface area of the article to be cooled.

The heat exchanger portion may comprise a container having a plurality of heat exchange surfaces.

The heat exchange surfaces may comprise a plurality of exchange conduits or apertures arranged to permit air to pass through the heat exchanger portion in thermal communication with fluid in the heat exchanger portion.

The heat exchanger portion may be formed from a thermally transmissive material.

Alternatively the apparatus may comprise a heat exchanger portion provided in thermal communication with the second fluid reservoir, the apparatus being arranged to pass coolant gas through the heat exchanger portion to allow heat exchange between the coolant gas and fluid in the second reservoir, subsequently to direct the coolant gas towards, onto or around the article.

The heat exchanger portion may comprise one or more conduits in thermal communication with fluid in the second fluid reservoir. The one or more conduits may be immersed in fluid in the second fluid reservoir. The heat exchanger portion may comprise a plurality of conduits, optionally an array of spaced apart conduits, optionally substantially parallel to one another, within the second fluid reservoir.

The apparatus may comprise a fan or compressor in fluid communication with the heat exchanger portion via a duct for pumping coolant gas through the heat exchanger portion.

The heat exchanger portion may be formed from a thermally transmissive material.

In an embodiment, the apparatus is configured to be disposed within a conventional refrigerator or the like. In this embodiment, the cooling means may comprise the existing cooling element of the refrigerator. The apparatus may be arranged to be positioned within the refrigerator such that the first fluid reservoir is in thermal communication with the existing cooling element so as to cool the fluid therein.

The apparatus may for example be in the form of a structure formed to fit within a conventional refrigerator. The apparatus may be moulded or otherwise formed to fit within a conventional refrigerator.

In some embodiments, the cooling means may be arranged to cool fluid in the first fluid reservoir (and optionally substantially all or at least a portion of fluid in the second fluid reservoir) below the critical temperature. In some arrangements substantially all the fluid in the first reservoir may be frozen, and optionally at least a portion of fluid in the second fluid reservoir frozen also. Rising and falling of fluid in the first fluid reservoir at least may therefore be substantially suspended, and a temperature of fluid in the second fluid reservoir may fall below the temperature that would otherwise be attained if the apparatus operated in a normal mode of operation as described above. This will be particularly the case where the weir means is arranged to have a relatively high thermal conductivity as described above.

However, if a cooling power of the cooling means is subsequently reduced or suspended such that warming of at least a portion of the fluid in the first fluid reservoir takes place, the apparatus may assume operation in the normal mode. That is, fluid below the critical temperature rises in the first reservoir due to buoyancy and undergoes thermal exchange with fluid in the second reservoir, whereby a cooling effect is imposed on fluid above the critical temperature that has risen due to buoyancy in the first reservoir. Fluid rising in the second fluid reservoir that is cooled in the thermal transfer region to or towards the critical temperature may subsequently sink under gravity, thereby having a cooling effect on fluid in the second fluid reservoir. Thus, relatively stable temperature conditions may be maintained in the second fluid reservoir despite gradual warming of fluid in the first fluid reservoir (e.g. due to melting of frozen fluid).

It is to be understood that whilst rising and falling has been referred to above, in some embodiments during normal, equilibrium operation, a situation may be achieved in which fluid in the first and/or second reservoirs is substantially static, and thermal transfer occurs primarily by conduction through the fluid. Alternatively or in addition, movement of fluid may be sufficiently slow that substantially static or quasi-static conditions are established.

In one aspect of the invention for which protection is sought there is provided an apparatus for cooling objects such as food items, beverages or vaccines comprising at least two reservoirs, a cooling means for cooling fluid contained in one of the reservoirs and a thermal transfer region between respective upper regions of the reservoirs. The thermal transfer region permits thermal transfer between the fluid contained in the reservoirs such that cooling of the fluid in one reservoir causes cooling of the fluid in the other reservoir.

In an embodiment cooling of fluid in the first reservoir is provided by means of a flow of a subject fluid through a heat exchanger to cool the first fluid.

Optionally, the subject fluid fluid may for example be a fluid that has been and/or is to be used in a process. For example, the subject liquid may be a refrigerant that has been used in a cooling process, for example to cool a heat exchanger of a freezer. Refrigerant exiting the heat exchanger of the freezer may be at a temperature of (say) −5° C. or any other suitable temperature below the critical temperature of fluid in the first reservoir. The refrigerant may be arranged to pass through a heat exchanger such as a tube immersed in the fluid in the first fluid reservoir, to cool the fluid. The refrigerant may then be returned to a compressor where it may be compressed and cooled in a further heat exchanger before being caused to expand to effect cooling.

In an embodiment, a further heat exchange fluid is employed to draw heat from fluid in the first fluid reservoir, the heat exchange fluid being subsequently cooled by a further fluid, such as refrigerant that has exited a heat exchanger of a freezer or other system.

Other arrangements are also useful.

In some embodiments, a source of fluid for cooling fluid in the first reservoir may be provided by water from a lake, river or sea that is at a temperature below the critical temperature. For example, a source of water at a temperature close to or below 0° C. may be employed.

Other arrangements are also useful.

In one aspect of the invention for which protection is sought there is provided refrigeration apparatus comprising: a casing; a fluid volume disposed within the casing and comprising weir means dividing the fluid volume into a first, central fluid reservoir, and second and third, outer fluid reservoirs; cooling means disposed in the first fluid reservoir for cooling fluid contained in the first fluid reservoir; a thermal transfer region defined, at least in part, by respective upper regions of the fluid reservoirs for permitting heat transfer between fluid contained in the first fluid reservoir and fluid contained in the second and third fluid reservoirs; and a first payload compartment disposed within the casing and in thermal communication with the second and third fluid reservoirs.

Optionally a second payload compartment may be disposed within the casing and in thermal communication with the second and third fluid reservoirs.

In a further aspect of the invention for which protection is sought there is provided refrigeration apparatus comprising: a casing; a fluid volume disposed within the casing and comprising a cylindrical weir means dividing the fluid volume into a first, inner fluid reservoir, and a second, outer fluid reservoir; cooling means disposed in the first fluid reservoir for cooling fluid contained in the first fluid reservoir; a thermal transfer region defined, at least in part, by respective upper regions of the fluid reservoirs for permitting heat transfer between fluid contained in the first fluid reservoir and fluid contained in the second fluid reservoir; and a payload compartment disposed within the casing, at least partially surrounding the fluid volume and in thermal communication with the second fluid reservoir.

In one aspect of the invention for which protection is sought there is provided a method comprising: cooling a fluid in a lower region of a first fluid reservoir; permitting fluid within the first fluid reservoir at a temperature below a critical temperature of the fluid to rise to an upper region of the first fluid reservoir; mixing the fluid at a temperature below the critical temperature with fluid at a temperature above the critical temperature from a second fluid reservoir in a thermal transfer region disposed between respective upper regions of the first and second fluid reservoirs; and permitting fluid at the critical temperature in the thermal transfer region to sink into at least the second fluid reservoir.

The method may comprise permitting fluid at the critical temperature in the thermal transfer region to sink into at least the second fluid reservoir so as to cool a payload compartment in thermal communication therewith.

In a further aspect of the invention for which protection is sought there is provided apparatus comprising: first and second fluid reservoirs; cooling means for cooling fluid contained in the first fluid reservoir; and a thermal transfer region disposed between respective upper regions of the first and second fluid reservoirs for permitting thermal transfer between the fluid contained in the first fluid reservoir and fluid contained in the second fluid reservoir.

Within the scope of this application it is expressly intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments, unless there is incompatibility of features.

DETAILED DESCRIPTION OF EMBODIMENTS

Embodiments of the present invention will now be described, by way of example only, with reference to the accompanying drawings, in which.

Figure 9A:
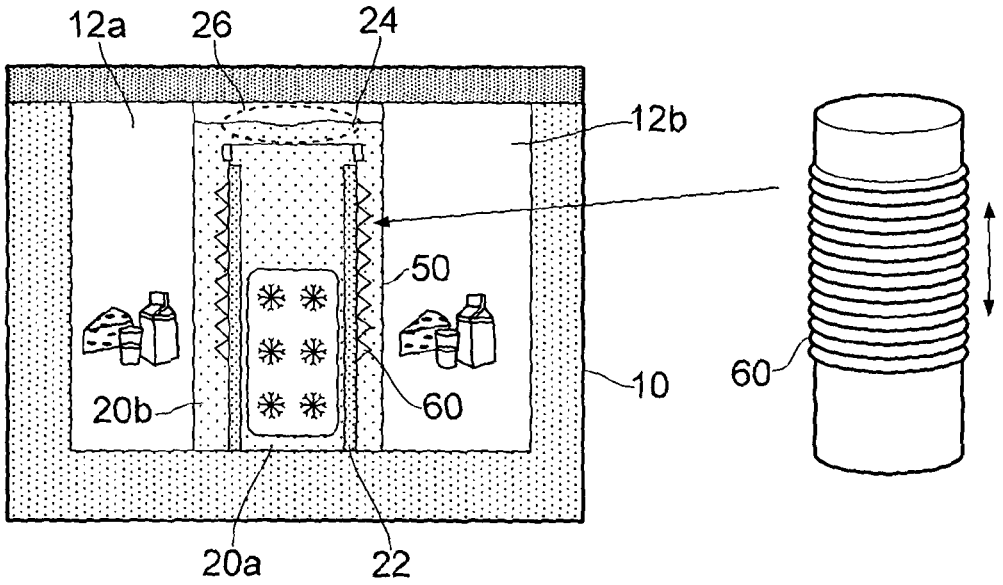
Figure 9B:
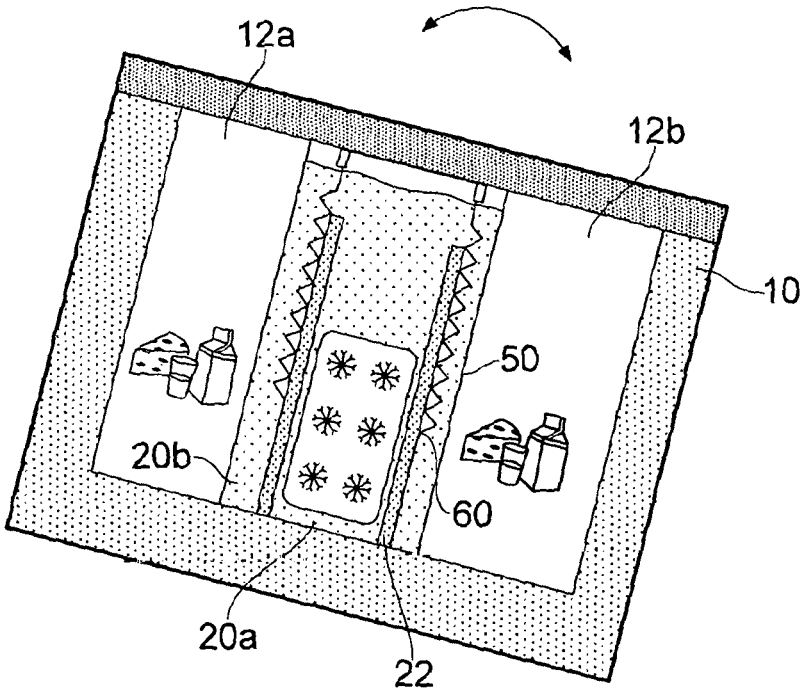
Figure 10:
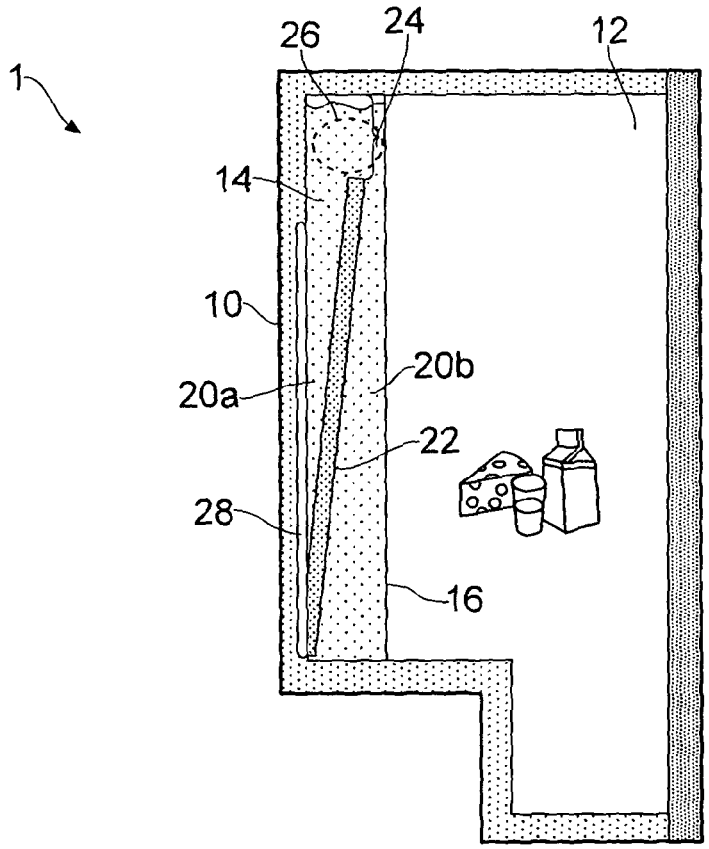
Figure 11:
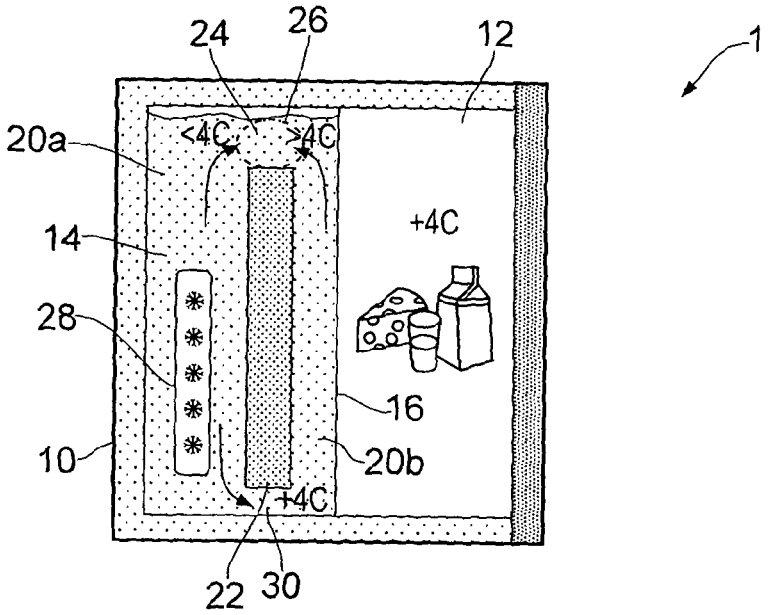
Figure 12:
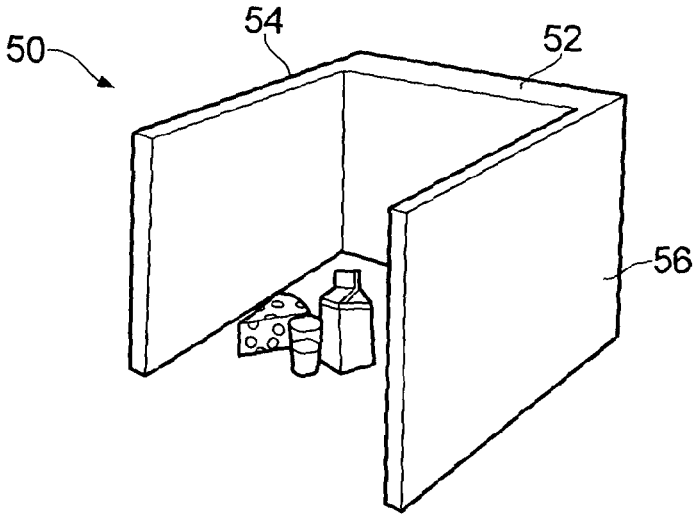
Figure 13:
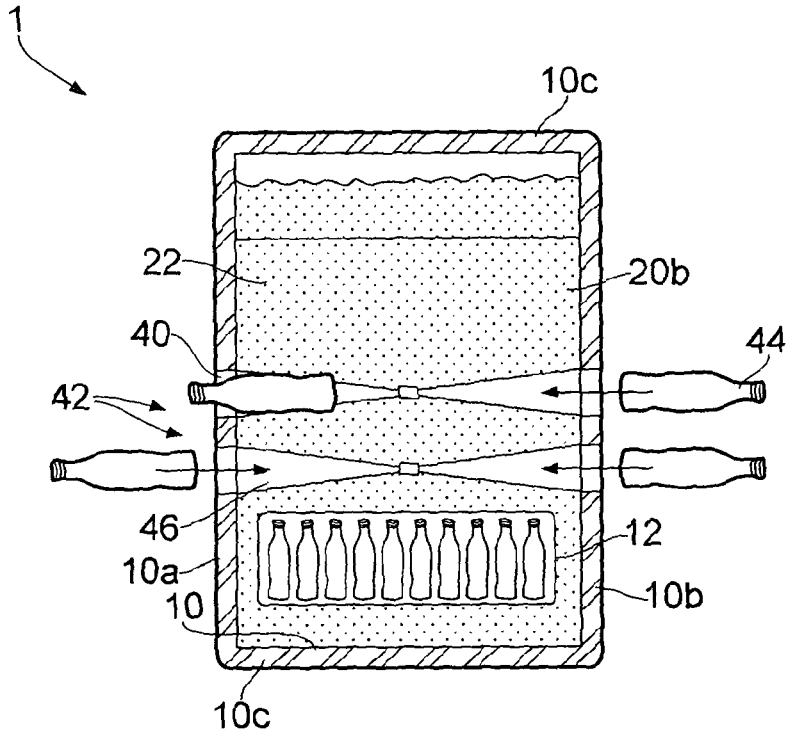
Figure 14:
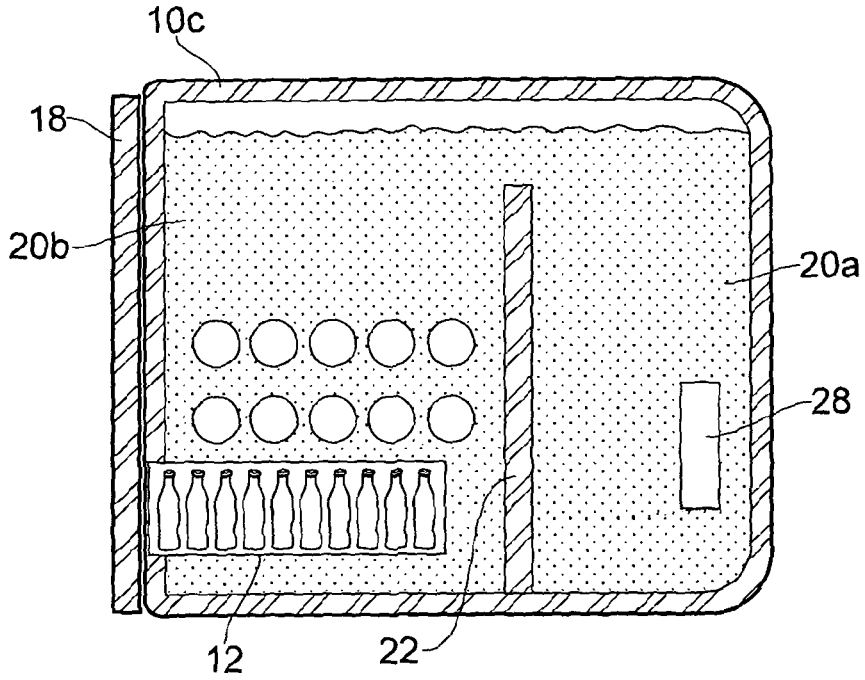
Figure 15:
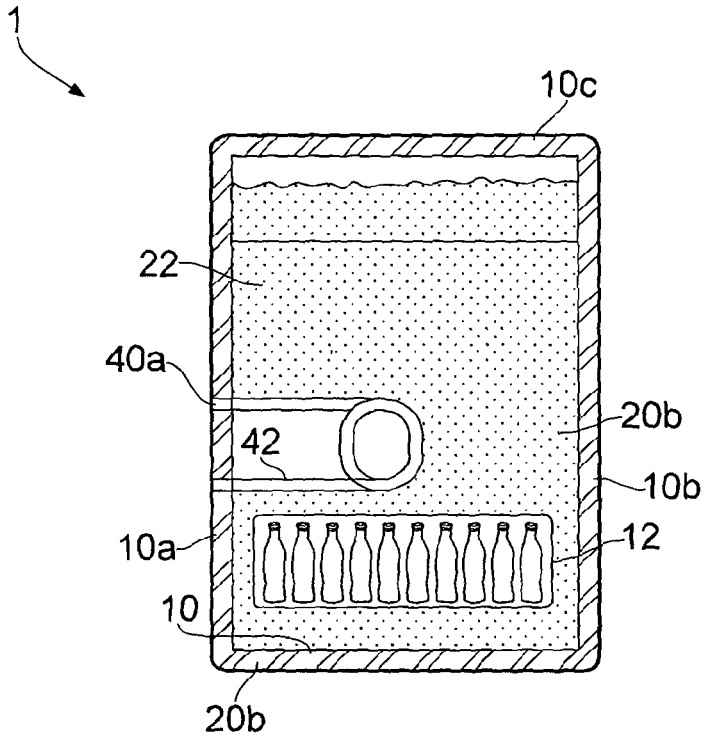
Figure 16:
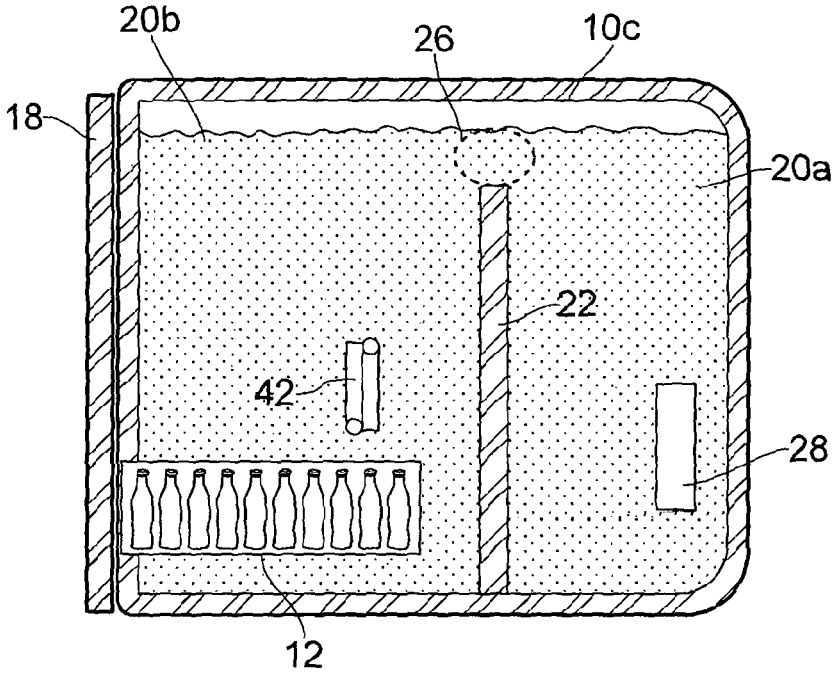
Figure 20:
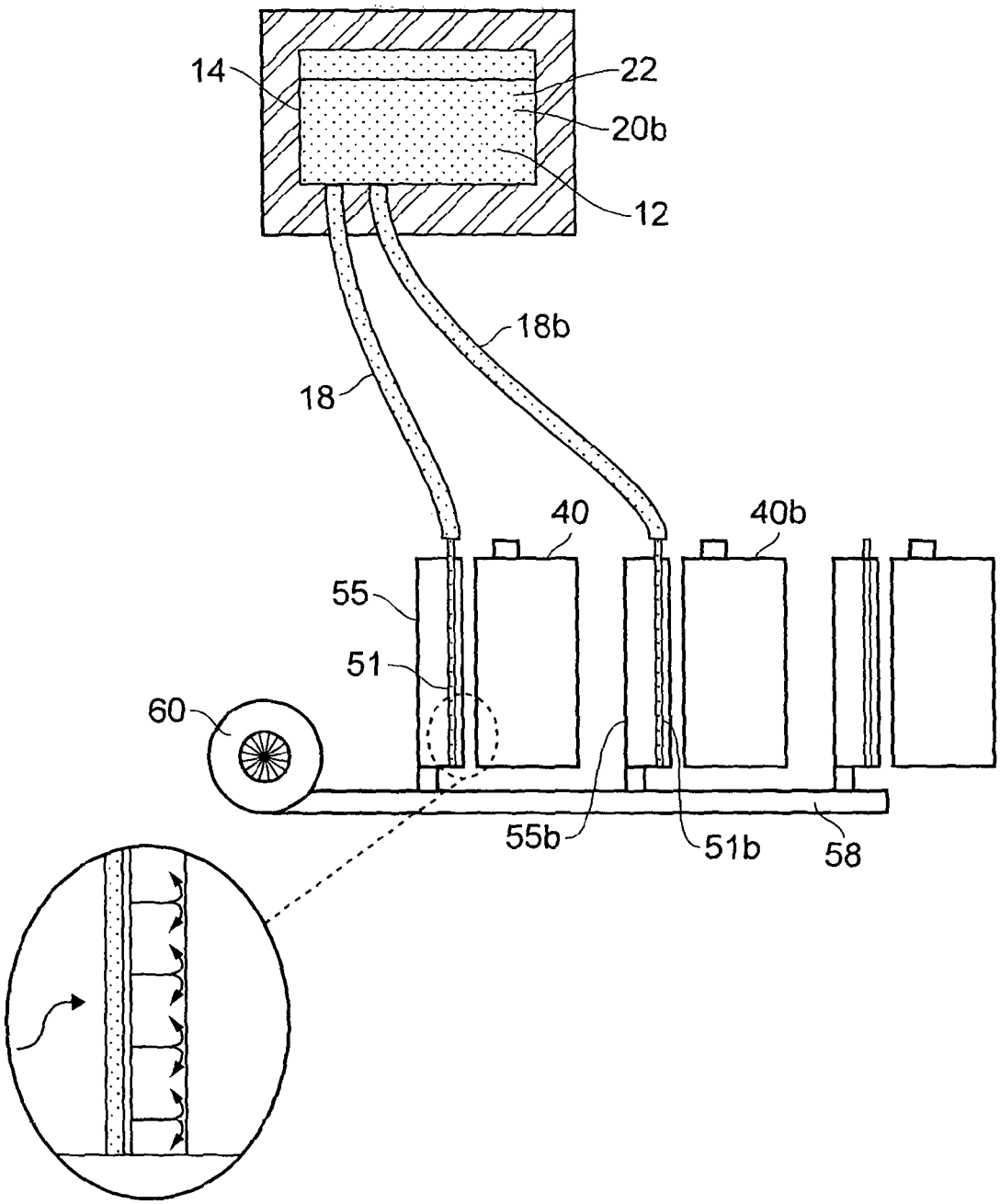
Figure 21:
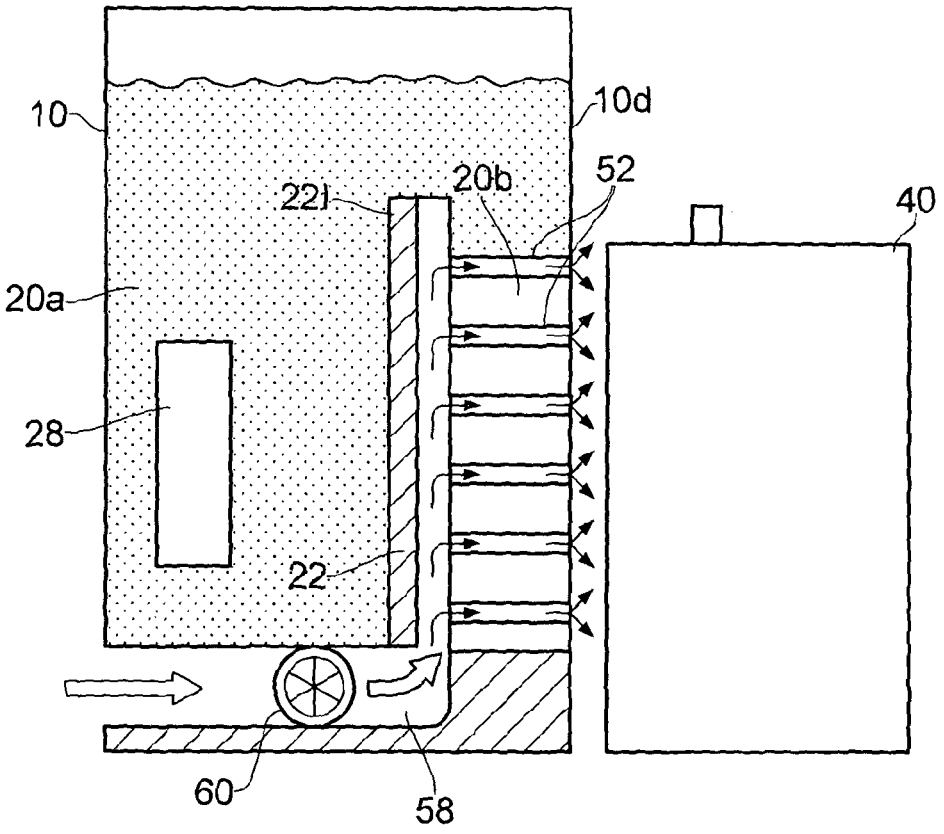

FIGS. 9*a* and 9*b* illustrate a section through an apparatus embodying another form of the invention;

FIG. 10 is a section through an apparatus embodying yet another form of the invention;

FIG. 11 is a section through an apparatus embodying another form of the invention;

FIG. 12 is a perspective view of a liner suitable for placing inside an insulated container for cooling objects in the container;

FIG. 13 is a front view of apparatus according to a further embodiment of the invention with a front portion of a casing of the apparatus removed;

FIG. 14 is a side view of apparatus according to the embodiment of FIG. 13 with a side portion of the casing of the apparatus removed;

FIG. 15 is a front view of apparatus according to a further embodiment of the invention with a front portion of a casing of the apparatus removed;

FIG. 16 is a side view of apparatus according to the embodiment of FIG. 15 with a side portion of the casing of the apparatus removed;

FIG. 17 is a graph illustrating how the useable life of a battery varies with temperature;

FIG. 18 is a schematic illustration of an apparatus embodying one form of the invention;

FIG. 19 is an expanded view of a section of a heat exchanger being a part of the apparatus of FIG. 18;

FIG. 20 is a schematic illustration of an apparatus embodying a second form of the invention; and FIG. 21 is a schematic illustration of an apparatus embodying a further form of the invention.

Within the following description, as far as possible, like reference numerals indicate like parts.

Figure 1:
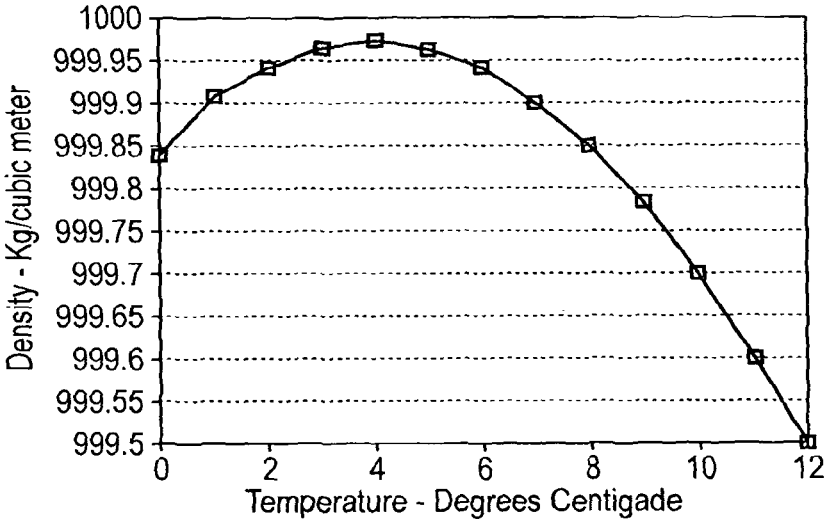
FIG. 1 is a graph of the density of water against temperature.

It will be understood from the foregoing that operation of some embodiments of the present invention relies upon one of the well-known anomalous properties of certain fluids such as water: namely, that its density is maximum at a critical temperature (in the case of water, approximately 4° C.), as shown in FIG. 1. Reference to water as an example be used herein, but it is to be understood that other fluids having a similar property are also useful. Fluids comprising water are also useful, such as water and a salt. The salt may allow the critical temperature to be lowered. Other additives are useful for lowering or raising the critical temperature of water, or other fluids.

The fact that water has a maximum in density as a function of temperature at the critical temperature is a consequence of the fact that water has a negative temperature coefficient of thermal expansion below approximately 4° C. and a positive temperature coefficient of thermal expansion above approximately 4° C. Hereinafter, the term "critical temperature" will be used to refer to the temperature at which the density of the fluid is at its maximum, being approximately 4° C. in the case of water.

In the apparatus disclosed in co-pending PCT application no. PCT/GB2010/051129, a headspace is disposed above the payload space. This arrangement is functionally advantageous but may be compromised in terms of packaging for certain applications. More particularly, the applicants have identified that the disposition of the headspace above the payload space may limit the retail frontage available for use in some arrangements. That is to say, the head space occupies a portion of the apparatus volume at the front of the apparatus which may be the most valuable or useful refrigerated storage space.

The applicants have discovered that it is possible to position the headspace, i.e. the reservoir containing the cooling means, behind the storage compartment (as opposed to above it) and yet still achieve sufficient cooling of the storage compartment using a similar thermal principle to that of the earlier application.

Figure 2:
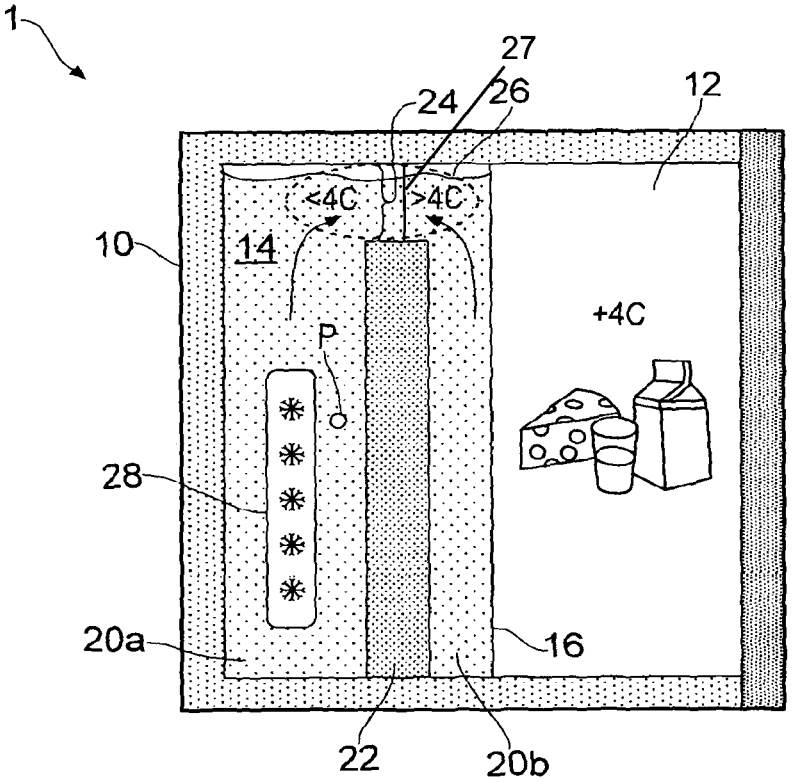
FIG. 2 is a section through an apparatus embodying one form of the invention.

Referring firstly to FIG. 2, a refrigeration apparatus embodying a first form of the invention is shown generally at 1.

The apparatus 1 comprises a casing 10, which is, in this embodiment, shaped generally as an upright cuboid. The casing 10 is formed from a thermally insulative material to reduce heat transfer into or out of the apparatus 1. For example, the casing 10 may be formed as a one-piece rotational moulding of a plastic material. The volume within the casing 10 is divided into adjacent compartments, a payload compartment 12 and a fluid volume 14, by means of a separator comprising a thermally conductive wall 16 extending between the upper, lower and side walls of the casing 10.

Figure 3:
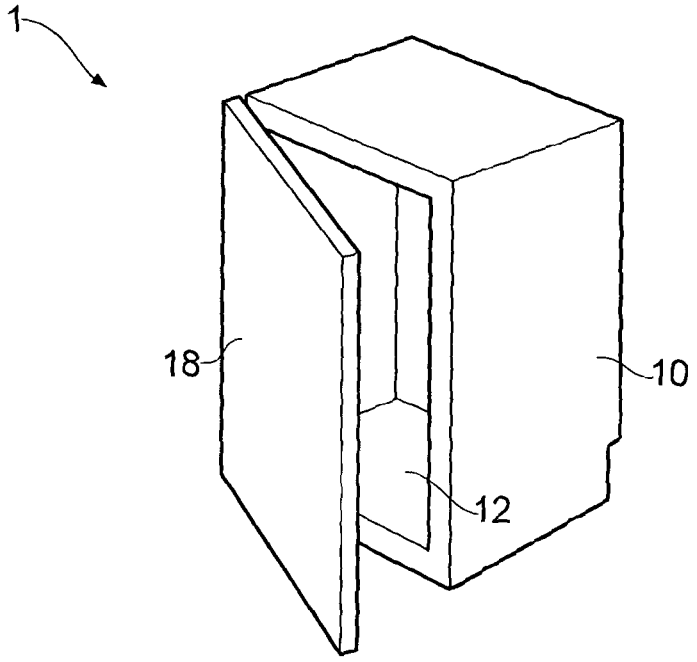
FIG. 3 is a perspective view of an apparatus embodying another form of the invention.

The payload compartment 12 is arranged to store one or more objects or items to be cooled, such as vaccines, food items or packaged drinks. As shown in FIG. 3, the payload compartment 12 may comprise a closure such as a door 18 which can be opened to gain access to the compartment through the open face of the casing 10. Insulating material is carried on the door 18 so that, when it is closed, heat transfer therethrough is reduced. In an alternative embodiment (not shown) the payload compartment 12 may be open-faced, permitting easy access to objects or items stored therein. For example, the payload compartment may comprise a shelving unit for use in retail outlets or shops.

The fluid volume 14 is itself partially divided into respective first and second fluid reservoirs 20*a*, 20*b* by weir means in the form of a thermal barrier or wall 22 extending upwardly from the lower wall of the fluid volume 14, and fully between the side walls thereof. The wall 22 may be formed of substantially any material having suitable thermal insulative properties. In particular, it is advantageous for the wall 22 to be formed from a material having a low thermal conductivity so as to reduce thermal transfer therethrough between the first and second fluid reservoirs. In some alternative arrangements a gap may be provided between the wall 22 and side walls of the fluid volume 14 defined by the casing 10.

In the illustrated embodiment, the wall 22 terminates a distance from the upper wall such that a slot or opening 24 is defined therebetween. The slot or opening 24 thereby provides a fluid and/or thermal flowpath between upper regions of the respective first and second fluid reservoirs 20 *a*, 20 *b*. The first and second fluid reservoirs 20 *a*, 20 *b* are thus in fluid communication at their upper regions which together define a fluid mixing region, shown approximately by the dashed line 26 and described below. Alternatively, the fluid reservoirs are in fluid isolation from one another. In this embodiment, a fluid-tight, thermally conducting barrier 27 may be disposed between the upper regions of the fluid reservoirs. The region at or adjacent to the thermally conducting barrier may thus define said thermal transfer region.

Cooling means, in the form of an electrically powered cooling element 28, is disposed within the first fluid reservoir 20*a* so as to be immersed in the fluid. The cooling element 28 is disposed in a lower region of the first fluid reservoir 20*a* and is spaced from the side, end, upper and lower walls of the reservoir by a layer of fluid. The apparatus has an external power supply (not shown) to supply electrical power to the cooling element 28. The power supply can operate from a supply of mains power in the absence of bright sunlight. The power supply can also operate from photovoltaic panels (not shown) whereby the apparatus 1 can be run without the need of a mains supply during sunny daytime conditions.

In some embodiments the cooling element 28 may be arranged to cool fluid in the first fluid reservoir 20*a* by means of a refrigerant pumped therethrough by means of a pump external to the fluid volume 14. In some embodiments the cooling element 28 is pumped by refrigerant that has been cooled by expansion of compressed refrigerant in the manner of a conventional vapour-compression refrigeration cycle.

The first and second fluid reservoirs 20*a*, 20*b* each contain a volume of a fluid having a negative temperature coefficient of thermal expansion below a critical temperature and a positive temperature coefficient of thermal expansion above the critical temperature. In the illustrated embodiments, the fluid is water, the critical temperature for which is approximately 4° C. The water largely fills both fluid reservoirs 20*a*, 20*b*, but a small volume may be left unfilled in each to allow for expansion. As noted above, liquids other than water are also useful. In particular, liquids are useful that have a critical temperature below which the density of the liquid decreases as a function of decreasing temperature (i.e. having a negative temperature coefficient of thermal expansion when cooled below the critical temperature) and above which the density of the liquid decreases as a function of increasing temperature (i.e. having a positive coefficient of thermal expansion when heated above the critical temperature).

Operation of the apparatus 1 will now be described.

It can be assumed that all of the water in the first and second fluid reservoirs 20*a*, 20*b* is initially at or around the ambient temperature. The apparatus 1 is activated such that electrical power is supplied to the cooling element 28, which thereby cools to a temperature that is typically well below the freezing point of water, for example, as low as −30° C. This, in turn, causes water in the immediate surroundings of the cooling element 28 within the first fluid reservoir 20*a* to cool. As the water cools, its density increases. The cooled water thus sinks towards the bottom of the first fluid reservoir 20*a* displacing warmer water which rises towards the upper region of the first fluid reservoir 20*a*.

It will be appreciated that, over time, most or all of the water contained in the first fluid reservoir 20*a* is cooled to a temperature of 4° C. or less. Because the density of water is at its maximum at the critical temperature, water at this temperature tends to pool at the bottom of the first fluid reservoir 20*a* displacing lower temperature water towards the upper region of the first fluid reservoir 20*a*. This leads to a generally positive temperature gradient being generated within the first fluid reservoir 20*a* with water at the critical temperature lying in the lower region of the first fluid reservoir 20*a* and less dense, more buoyant water at temperatures below the critical temperature lying in the upper region adjacent the opening 24 at the junction between the first and second fluid reservoirs 20*a*, 20*b*.

At this junction, hereafter referred to as the fluid mixing region 26, water at temperatures below the critical temperature displaced upwardly by the sinking of water at the critical temperature within the first fluid reservoir 20*a* meets and mixes with warmer water, for example at approximately 10° C., disposed in the upper region of the second fluid reservoir 20*b*. A transfer of heat from the warmer water to the colder water thus occurs within the mixing region 26, causing the cold water from the first fluid reservoir 20*a* and the warmer water from the second fluid reservoir 20*b* to increase and decrease in temperature, respectively, towards the critical temperature. The fluid mixing region 26 thus defines a thermal transfer region of the apparatus 1 wherein transfer of heat between fluid from the first and second fluid reservoirs occurs.

As the cold water from the first fluid reservoir 20*a* rises in temperature towards the critical temperature, its density increases, as shown in FIG. 1, and thus it sinks back down towards the cooling element 28, displacing cooler water below. Similarly, as the warmer water from the second fluid reservoir 20*b* reduces in temperature towards the critical temperature, its density increases and thus it, too, sinks down towards the lower region of the second fluid reservoir 20*b* displacing warmer water below.

The water in the second fluid reservoir 20*b* cooled following mixing within the mixing region 26 pools at the bottom of the second fluid reservoir 20*b* which, as described above, is disposed in thermal communication with the payload compartment 12. Heat from the payload compartment 12 is thus absorbed by the cooled volume of water in the second fluid reservoir 20*b* and the temperature of the payload compartment 12, and hence the objects or items stored therein, begins to decrease.

To reiterate, water within the first fluid reservoir 20*a* cooled to temperatures below the critical temperature by the cooling element 28 is displaced upwardly towards the mixing region 26 by water at the critical temperature. Conversely, within the second fluid reservoir 20*b*, water above the critical temperature is displaced upwardly towards the mixing region 26 by water at the critical temperature. Thus, water on either side of the thermal barrier 22, and at temperatures on either side of the critical temperature, merge and mix within the mixing region 26 causing the average temperature of the water in the mixing region 26 to approach the critical temperature and thus to cascade or sink back into the lower regions of the respective fluid reservoirs 20*a*, 20*b*.

Over time, this process reaches something approaching a steady state through the dynamic transfer of heat between water at temperatures below the critical temperature rising to the upper region of the first fluid reservoir 20*a* and water at temperatures above the critical temperature rising to the upper region of the second fluid reservoir 20*b*. In some embodiments, in the steady state fluid in the first and optionally the second reservoir in addition is substantially static, thermal transport taking place primarily via conduction.

The applicants have discovered the surprising technical effect that, over time, despite the cooling element 28 being disposed in a lower region of the first fluid reservoir 20*a*, the temperature of the water in the second fluid reservoir 20*b* reaches a steady state temperature approximately at the critical temperature. That is to say, much or all of the water in the second fluid reservoir 20*b*, particularly at the lower region thereof, becomes comparatively stagnant, with a temperature of around 4° C. Water heated above the critical temperature by absorption of heat from the payload compartment 12 is displaced towards the mixing region 26 by water at the critical temperature descending from the mixing region 26 having been cooled by the below-critical temperature water in the upper region of the first fluid reservoir 20*a*.

Through absorption of heat from the payload compartment 12 by the water in the second fluid reservoir 20*b*, the payload compartment 12 is maintained at a desired temperature of approximately 4° C. which is ideal for storing many products including vaccines, food items and beverages.

It is to be understood that fluid in contact with the cooling element 28 will typically freeze, and a solid mass of frozen fluid or ice will form in the first fluid reservoir. An ice detector may be provided for detecting the formation of ice once the ice has grown to a critical size. Once the detector detects the formation of ice of the critical size the apparatus may be arranged to switch off the cooling element 28 to prevent further ice formation. Once the mass of frozen fluid has subsequently shrunk to a size below the critical size, the cooling element may be reactivated. The detector may be in the form of a thermal probe P in thermal contact with fluid a given distance from the cooling element 28. Fluid in thermal contact with the detector will fall to a temperature at or close to that of the frozen fluid once the frozen fluid comes into contact with the detector P. It is to be understood that a relatively abrupt temperature change typically takes place between the mass of frozen ice and fluid in contact with the ice within a very short distance from the frozen mass.

In the event that the power supply to the cooling element 28 is interrupted or disconnected, the displacement process imparted upon the water within the first and second fluid reservoirs 20*a*, 20*b* continues whilst the mass of frozen fluid remains in the first fluid reservoir 20*a*. Once the mass of frozen fluid is exhausted, the displacement process will begin to slow but is maintained by the continued absorption of heat from the payload space 12 by the water in the second fluid reservoir 20*b*. Due to the high specific heat capacity of water and the significant volume of water at temperatures below the critical temperature within the fluid volume, the temperature in the lower region of the second fluid reservoir 20*b* remains at or close to 4° C. for a considerable length of time.

That is to say, even without a supply of electrical power to the cooling element 28, the natural tendency of water at the critical temperature to sink and displace water above or below the critical temperature results in the first and second fluid reservoirs 20*a*, 20*b*, or at least the lower regions thereof, holding water at or around the critical temperature for some time after loss of power, enabling the payload compartment 12 to be maintained within an acceptable temperature range for extended periods of time. Embodiments of the present invention are capable of maintaining fluid in the second reservoir 20*b* at a target temperature for a period of up to several weeks following loss of power.

Figure 4:
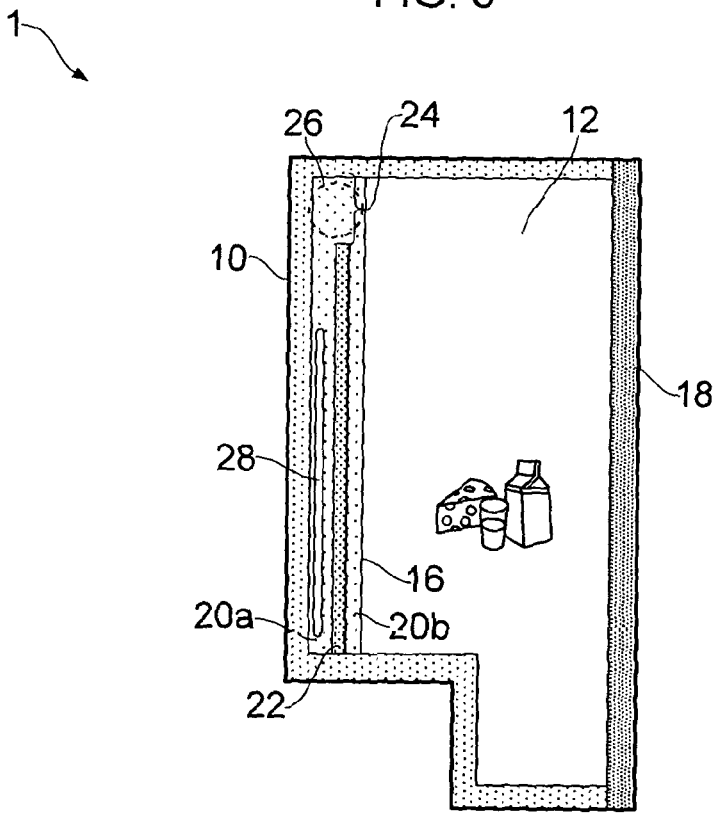
FIG. 4 is a section through an apparatus embodying another form of the invention.
Figure 5:
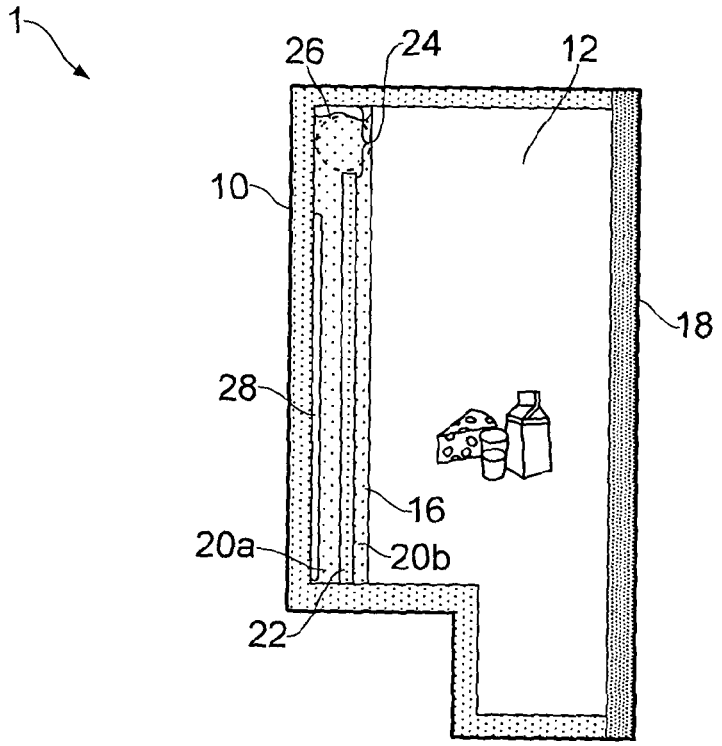
FIG. 5 is a section through a variation to the apparatus of FIG. 4.

FIGS. 4 and 5 illustrate a variation of the embodiment of FIG. 2 adapted to be retrofitted to an existing refrigeration device. In the embodiment of FIG. 4, the external shape of the casing 10 is configured to complement, and sit within, the internal volume of a conventional refrigerator (not shown). In particular, a lower region of the rear face of the casing 10 is stepped inwardly to accommodate the housing for the condenser and motor of the refrigerator which is often disposed at the lower rear portion of the refrigerator.

In the embodiment of FIG. 5, in addition to the revised external shape of the casing 10, the cooling element 28 is disposed outside of the first fluid reservoir 20*a* and is instead integrated into the rear wall of the casing 10 and in thermal communication with the water contained in the first fluid reservoir 20*a*.

Operation of the embodiments of FIGS. 4 and 5 is substantially identical to that of the embodiment of FIG. 2. It will also be appreciated that the positioning of the cooling element 28 outside of the first fluid reservoir 20*a* can be implemented independently of the external shape of the casing 10, for example in the embodiment of FIG. 2.

In a further variation of the embodiments of FIGS. 4 and 5 (not shown), the cooling element 28 is eliminated and the rear wall of the casing 10 is replaced by a thermally conductive portion such as a membrane or other thermally conductive plate, element, member or structure. In this arrangement, the cooling means comprises the existing refrigeration device itself, the cooling element of the refrigeration device being used to perform the function of the cooling element 28. The operation of such an embodiment is substantially identical to that of FIG. 2 in that the water in the first fluid reservoir 20*a* is cooled, in this case by the cooling apparatus of the refrigeration device in thermal communication therewith, through the conductive membrane thereby establishing the thermally-induced fluid displacement process described above.

Figure 6:
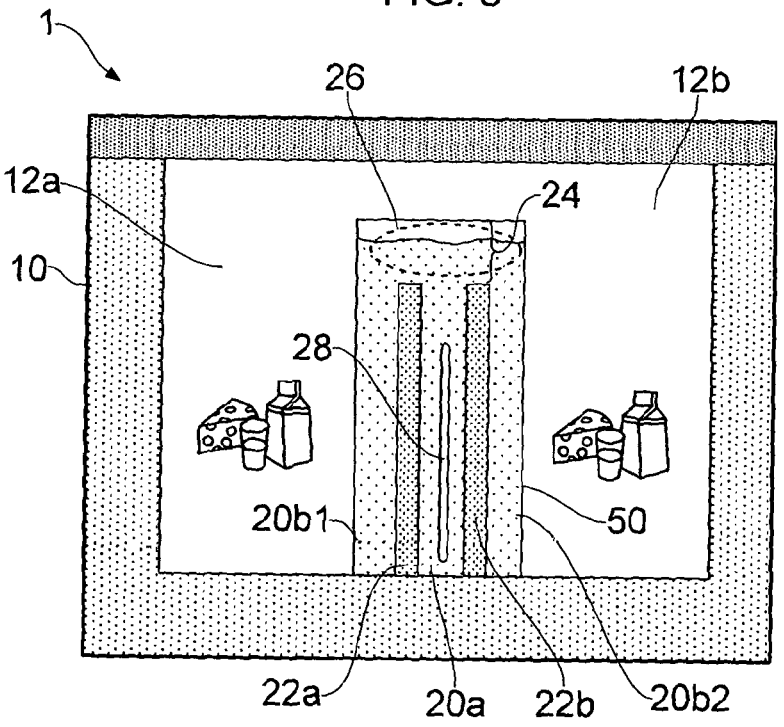
FIG. 6 is a section through an apparatus embodying a further form of the invention.
Figure 7:
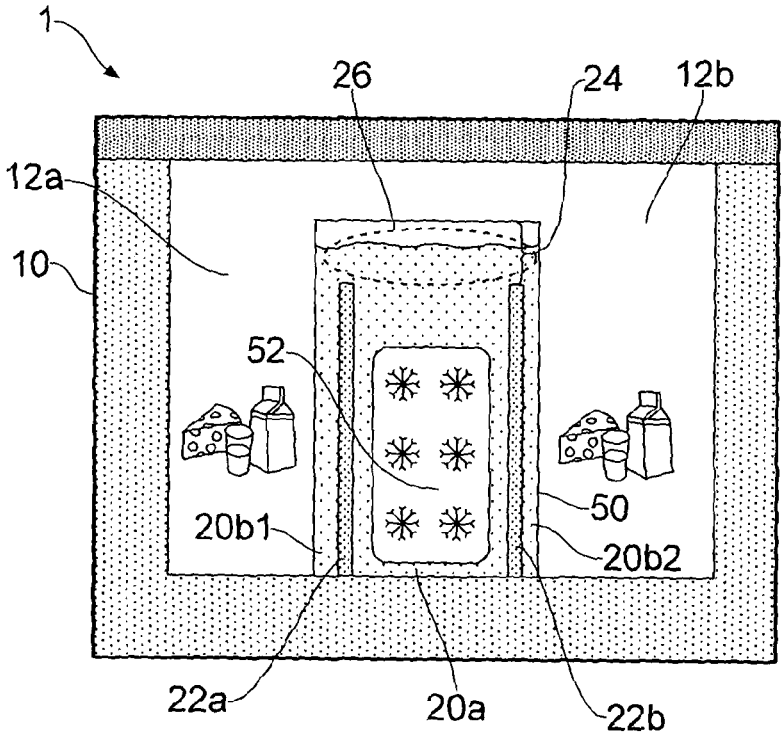
FIG. 7 is a section through a variation to the apparatus of FIG. 6.

Referring next to the embodiments of FIGS. 6 and 7, a dual payload space arrangement is shown. In this embodiment, a fluid-filled cooling chamber 50 is provided within the casing 10 with payload compartments 12*a*, 12*b* defined on either side thereof. The cooling chamber is at least partially divided into three chambers defining respectively, a central fluid reservoir 20*a* and two outer fluid reservoirs 20*b*1, 20*b*2, by weir means in the form of two upright, generally parallel walls 22*a*, 22*b*. In the illustrated embodiment, the walls 22*a*, 22*b* do not extend fully to the upper wall of the cooling chamber 50 and thereby define a fluid mixing region 26 disposed across the upper regions of the respective fluid reservoirs 20*a*, 20*b*1, 20*b*2.

In this embodiment, the central fluid reservoir 20*a* contains the cooling means in the form of an electrically powered cooling element 28 and thus is functionally equivalent to the first fluid reservoir 20*a* of the embodiment of FIG. 2. Similarly, each of the outer fluid reservoirs 20*b*1, 20*b*2 is in thermal communication with a respective payload compartment 12*a*, 12*b* and thus is functionally equivalent to the second fluid reservoir 20*b* of the embodiment of FIG. 2.

Operation of the embodiment of FIG. 6 is similar to that of the embodiment of FIG. 2. Specifically, water cooled to below the critical temperature within the central fluid reservoir 20*a* is displaced towards the fluid mixing region 26 by water at the critical temperature sinking to the bottom of the reservoir. The below-critical-temperature water mixes with warmer water from the outer fluid reservoirs 20*b*1, 20*b*2 in the fluid mixing region 26, which warmer water is thereby cooled towards the critical temperature in a process of thermal transfer and thus sinks down into the outer fluid reservoirs, displacing warmer water upwardly into the fluid mixing region 26. The below-critical-temperature water from the central fluid reservoir 20*a* is warmed by this thermal transfer process towards the critical temperature and, due to the corresponding increase in density, sinks into the central fluid reservoir 20*a* thereby displacing colder water upwardly into the fluid mixing region 26, whereupon the process is repeated. It is to be understood that in some embodiments fluid that rises within one fluid reservoir may subsequently fall within a different fluid reservoir.

This process continues until the water in the outer fluid reservoirs 20*b*1, 20*b*2 reaches a substantially steady state of at or around 4° C. and is maintained at or near this temperature by the continuing thermally induced displacement of water within the reservoirs and the subsequent mixing within the fluid mixing region 26.

The embodiment of FIG. 7 is structurally similar to that of FIG. 6. In this embodiment, however, the cooling element 28 is replaced by a body of cold material 52 at a temperature that is below the intended operating temperature of the payload compartment. It will typically be below 0° C. A temperature of around −18° C. can be obtained by placing the body 52 in a conventional food freezer before use, and −30° C. or less would emulate the effect of a refrigeration unit. The body of cold material 52 can be anything with a suitable thermal mass. However, water ice is particularly suitable because it is readily available and has an advantageously high latent heat of fusion.

The ice may be in the form of standard 0.6 litre, plastic coated ice packs that are used in transport and storage of medical supplies. Other sizes of ice pack are also useful. Other arrangements may be used. In one embodiment, one or more blocks of ice, or a mass of ice cubes, is introduced into the central fluid reservoir 20*a*. In this case, since the displacement volume of the ice is greater than the equivalent volume when melted, the overall volume of water in the reservoir decreases as the ice melts. A sufficient draft of water above the thermal barriers 22*a*, 22*b* should be maintained within the cooling chamber 50 to enable fluid mixing when the volume of ice reduces during melting. A liquid drain arrangement may be provided in addition or instead in some arrangements.

Figure 8:
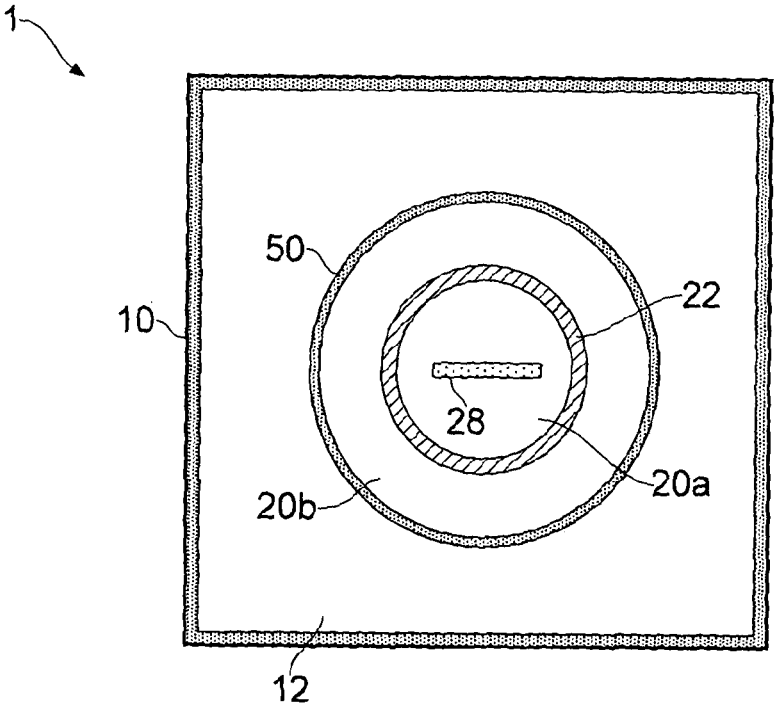
FIG. 8 is a section, in plan view, through an apparatus embodying a still further form of the invention.

FIG. 8 illustrates, in plan view, a still further embodiment of the invention. In this embodiment, a cylindrical fluid-filled cooling chamber 50 is disposed generally centrally within the casing 10 with the payload compartment 12 defined by the space outside of the cooling chamber 50. Other locations of the chamber 50 are also useful.

The cooling chamber 50 is divided into inner and outer fluid reservoirs 20*a*, 20*b* by weir means in the form of a generally upright, cylindrical or tubular wall 22 extending upwardly from a lower surface of the cooling chamber. The cylindrical volume bounded by the wall 22 comprises the inner fluid reservoir 20*a* while the annular volume outside of the wall 22 comprises the outer fluid reservoir 20*b*. In the illustrated embodiment, the wall 22 does not extend fully to the upper wall of the cooling chamber 50 and thereby defines a fluid mixing region (not shown) disposed across the upper regions of the respective fluid reservoirs 20*a*, 20*b*.

In this embodiment, the inner fluid reservoir 20*a* contains the cooling means in the form of an electrically powered cooling element 28 and thus is functionally equivalent to the first fluid reservoir 20*a* of the embodiment of FIG. 2. Similarly, the outer fluid reservoir 20*b* is in thermal communication with the payload compartment 12 and thus is functionally equivalent to the second fluid reservoir 20*b* of the embodiment of FIG. 2.

Operation of the embodiment of FIG. 8 is similar to that of the embodiment of FIG. 2. Specifically, water cooled to below the critical temperature within the inner fluid reservoir 20*a* is displaced towards the fluid mixing region 26 by water at the critical temperature sinking to the bottom of the reservoir. The below-critical-temperature water mixes with warmer water from the outer fluid reservoir 20*b* in the fluid mixing region 26, which warmer water is thereby cooled towards the critical temperature in a process of thermal transfer and thus sinks down into the outer fluid reservoir 20*b*, displacing warmer water upwardly into the fluid mixing region 26. The below-critical-temperature water from the inner fluid reservoir 20*a* is warmed by this thermal transfer process towards the critical temperature and, due to the corresponding increase in density, sinks into the central fluid reservoir 20*a* thereby displacing colder water upwardly into the fluid mixing region 26, whereupon the process is repeated.

This process continues until the water in the outer fluid reservoir 20*b* reaches a substantially steady state of at or around 4° C. and is maintained at or near this temperature by the continuing thermally induced displacement of water within the fluid reservoirs and the subsequent mixing within the fluid mixing region 26.

It will be appreciated that the embodiments of FIGS. 6-8 may find advantageous application in retail shelving such as that found in supermarkets. By disposing the cooling chamber 50 between oppositely accessible payload compartments 12*a*, 12*b*, or centrally within the casing so that a 360° payload compartment 12 is provided, the apparatus 1 can be positioned between adjacent aisles within the supermarket, or as a centrally positioned, standalone unit, providing increased retail frontage and improved flexibility for product placement.

Referring next to FIGS. 9*a* and 9*b*, a variation to the embodiment of FIG. 8 is shown. In this embodiment, the cooling chamber 50 extends fully between the upper and lower walls of the casing 10 (although this is not essential) and the thermal barrier 22 is surrounded by a cylinder or sleeve 60 formed from a material having low thermal conductivity. The length of the cylinder 60 is variable such that at its minimum length, it extends approximately to the end of the annular wall 22, thereby retaining the thermal flowpath between the inner and outer fluid reservoirs 20*a*, 20*b*, while at its maximum length it extends into abutment with the upper wall of the cooling chamber 50 or casing 10. In this extended-length configuration, the outer fluid reservoir 20*b* is in fluid isolation and thermally insulated (or isolated) from the inner fluid reservoir 20*a*.

In one embodiment, it is envisaged that the sleeve may take the form of a bellows arrangement 60 whose natural length is comparable to the height of the walls 22 but which can be stretched or expanded such that it can close and/or seal off the inner fluid reservoir 20*a*. The bellows 60 may comprise a bi-metallic structure configured in such a way that when cold, the bellows expands towards the closed position.

Such an arrangement may be beneficial for mobile applications wherein the refrigeration apparatus is required to be moved or re-located on a frequent or regular basis. Movement of the apparatus, and hence the fluid volume tends to stir up the water upsetting the normal thermally-induced fluid displacement process.

In the present embodiment, however, when stirred up through movement of the apparatus, colder water in the central fluid reservoir 20*a* may be caused to spill over into the outer fluid reservoir 20*b* thereby lowering the temperature therein. This drop in temperature "activates" the bellows arrangement 60 to close the slot or aperture 24 and hence substantially isolate the central fluid reservoir 20*a*, as shown in FIG. 9*b*.

Once the apparatus is relocated and the temperature of the water in the outer fluid reservoir 20*b* rises, the bellows arrangement 60 contracts to its natural length to permit the desired fluid displacement process to be re-established.

The inner surface of the bellows arrangement 60 may be insulated to prevent significant conduction of heat therethrough.

It will be appreciated from the foregoing that the bellows arrangement functions as a form of valve which can selectively close in order to disrupt the thermal conduction process within the apparatus and open when the process is to be re-established. It is also envisaged that the provision of such valve means may enable the temperature of the fluid in the outer fluid reservoir 20*b* to be varied. In particular, by reducing the depth of the gap 24 between the end of the wall 22 and the upper wall of the cooling chamber 50, such as by partially extending the bellows arrangement 60, the thermal conduction between the water in the central fluid reservoir 20*a* and the water in the outer fluid reservoir 20*b* can be selectively adjusted, for example decreased. This permits the temperature of the water in the outer fluid reservoir 20*b* to be increased above the critical temperature which may be beneficial depending on the nature of the objects or items contained in the payload compartment 12.

It is envisaged that the bellows arrangement 60 can be configured to operate, that is to say open and/or close, at any desired temperature, depending on the application. For example, in a battery cooler the bellows 60 may be arranged to close at a temperature of approximately 25° C. and to release colder water when the temperature of the water in the outer fluid reservoir 20*b* exceeds this level.

Valve means other than a bellows arrangement may be useful in some embodiments, for example slots having adjustable opening, a movable shutter, a gate valve, a ball valve, butterfly valve or any other suitable valve.

In another embodiment (not shown) the bellows arrangement 60 or other valve type is connected through the upper wall of the casing 10 to a retractable carrying handle attached thereto. The carrying handle is movable between a retracted position and a deployed, use position, the latter enabling the apparatus to be carried by a user. The bellows arrangement 60 or other valve means is connected to the handle in such a way that, in the deployed position of the handle, the bellows is extended into abutment with the upper wall, thereby substantially sealing off the central reservoir 20*a* from the outer fluid reservoir 20*b*. In the case of other valve means, lifting the handle means may cause closure of the valve means, for example by lifting a valve portion of a gate valve upwardly (or moving it downwardly) to isolate reservoir 20*a* from reservoir 20*b*. Such an arrangement ensures that, during movement of the apparatus 1 requiring deployment of the handle, the reservoirs are mutually isolated so as to limit mixing of fluid, and consequent thermal disruption, during transportation. Once the apparatus is relocated, the handle is lowered or retracted causing the bellows arrangement 60 to retract to its natural, open position, or other valve means to open.

It is envisaged that the handle may also be connected to a door or closure of the apparatus such that deploying the handle not only raises the bellows or closes other valve means and substantially seals off the fluid reservoirs but additionally locks the closure. Releasing the handle after relocation of the apparatus lowers the bellows arrangement 60 or opens other valve means and unlocks the closure.

It will be appreciated that the above-described bellows arrangement 60 is not limited to the embodiment of FIGS. 9*a* and 9*b* and can be readily adapted or re-configured for use in the embodiments of FIGS. 2-8.

It is to be further understood that as noted above the retractable handle described above may be connected to a valve not comprising a bellows arrangement. With the handle in a retracted position the valve may be arranged to open; with the handle in a deployed condition (such as when the apparatus is being carried) the valve may be arranged to close.

The above description assumes that the maximum density of water occurs at 4° C., which is the case for pure water. The temperature at which the maximum density occurs can be altered by introduction of impurities into the water. For example, if salt is added to the water to a concentration of 3.5% (approximately that of sea water) then the maximum density occurs at nearer 2° C. This can be used to adjust the temperature of the payload space for specific applications. Other additives may be employed to raise or lower the critical temperature, as required.

FIG. 10 illustrates a further embodiment in which the position of the wall 22 within the fluid volume 14 is adjustable. As with the above mentioned bellows arrangement 60, adjusting the position of the wall 22 allows the fluid displacement process to be modified, for example slowed or reduced. In the illustrated embodiment, wall 22 is pivotable about its lower end so as to vary the area of the upper openings of the first and second fluid reservoirs 20*a*, 20*b*. This can be used to affect the flow of fluid between the first and second fluid reservoirs and hence control the thermal transfer therebetween. For example, by tilting the wall 22 towards the payload compartment 12, the area of the upper opening of the second fluid reservoir 20*b* is reduced, thereby reducing the rate at which fluid is displaced therefrom. This, in turn, allows the temperature of the fluid in the second fluid reservoir 20*b* to be maintained at temperatures above 4° C. if required. It will be appreciated from the foregoing that the movable wall 22 in this embodiment also functions as a valve means. Thus the movable wall 22 may be considered to function as a valve.

Another beneficial effect provided by the wall 22 being tilted towards the payload compartment 12 is that ice formation within the first fluid reservoir 20*a* may be facilitated without blocking the upward flow of cooler water into the mixing region 26. This beneficial effect is equally applicable where the wall 22 is substantially permanently fixed at an angle inclined or tilted towards the payload compartment, an arrangement also envisaged within this application.

It will be appreciated that some embodiments of the present invention provide a novel and inventive device for storing and cooling items such as vaccines, perishable food items as well as a plurality of beverage containers such as bottles or drinks cans, providing a temperature controlled storage means which can be maintained within a desirable temperature range following loss of power to the device for many hours. Embodiments of the invention are arranged to passively regulate the flow of heat energy inside the device, to enable long-term storage of temperature sensitive products.

Of particular benefit is the feature that, in embodiments of the invention, the fluid reservoirs 20*a*, 20*b* are disposed in a side-by-side configuration with the payload compartment 12. By avoiding the use of a head-space above the payload compartment, greater versatility is provided for setting the size, shape and position of the payload compartment.

Other embodiments of the invention provide a cooler for cooling articles, such as a battery cooler for cooling batteries used as back-up power supplies. In this case, the battery may be housed in the payload compartment 12 or in another area in thermal communication with the second or outer fluid reservoirs 20*b*, 20*b*1, 20*b*2 (FIG. 6). In an embodiment, fluid in the second compartment 20*b* may be provided in fluid communication with a heat exchanger for cooling the battery, via one or more fluid conduits.

Thus the second fluid reservoir 20*b* may function as a source of coolant for cooling a structure, device or component. In some embodiments a heat exchanger may be passed through the second fluid reservoir, for example in the form of a fluid conduit, the conduit allowing thermal exchange between fluid flowing through the conduit such as a liquid or gas, and liquid in the second fluid reservoir 20*b*. The fluid flowing through the conduit may for example be a beverage, a fuel such as a liquid fuel, a gaseous fuel or any other suitable liquid.

Embodiments of the present invention may effect a relatively slow and/or gentle heat transfer process primarily by thermal conduction through the fluid but which, at start up of the system, may be effected more rapidly so as to cause the second or outer fluid reservoirs 20*b*, 20*b*1, 20*b*2 to reach a working temperature more quickly, by means of thermally-induced fluid displacement within the fluid volume.

FIG. 11 is a cross-sectional schematic illustration of a further embodiment in which the wall 22 is positioned within the fluid volume 14 such that a gap or slit 30 is provided between a lower edge of the wall 22 and a base of the casing 10. The gap 30 allows liquid to pass from the first fluid reservoir 20*a* to the second fluid reservoir 20*b* and vice versa.

In some alternative embodiments one or more slits or apertures may be provided in a lower region of the wall 22 to allow flow of fluid therethrough from one side of the wall 22 to the other. In some alternatives, a basal wall may be provided rising a relatively short distance from the base of the casing 10, the gap 30 being provided between an upper edge of the basal wall and wall 22.

In use, the presence of the gap 30 facilitates more rapid initial cooling of liquid in the second fluid reservoir 20*b* and therefore of the payload compartment 12. This is because, upon initial cooling, fluid that has been cooled by the cooling element 28 may initially sink as it cools towards its critical temperature. Once in the lower region of the first fluid reservoir 20*a* the fluid can effect cooling of fluid in the second reservoir 20*b*. Cooling of fluid in the second reservoir by fluid falling within the first reservoir 20*a* may occur by thermal conduction. In addition, cooling may be effected by passage of cooled fluid from the first fluid reservoir 20*a* to the second fluid reservoir 20*b* through the gap 30.

It is to be understood that, eventually, an equilibrium condition may be achieved in which fluid in the first reservoir 20*a* that is cooled by the cooling element 28 below the critical temperature is displaced upwardly by the sinking of fluid at the critical temperature and (in some embodiments) meets and mixes with warmer fluid, for example at approximately 10° C., disposed in the upper region of the second fluid reservoir 20*b*. A transfer of heat from the warmer fluid to the colder fluid thus occurs within mixing region 26, causing the colder fluid from the first fluid reservoir 20*a* and the warmer fluid from the second fluid reservoir 20*b* to increase and decrease in temperature, respectively, towards the critical temperature. The fluid mixing region 26 thus defines a thermal transfer region of the apparatus 1 wherein transfer of heat between fluid from the first and second fluid reservoirs 20*a*, 20*b* occurs. It is to be understood that where the fluids in the first and second reservoirs 20*a*, 20*b* are not permitted to mix in the region 26, the region 26 defines a thermal transfer region not being a fluid mixing region.

As described herein, the cooling element 28 may be in the form of a body of water ice, for example an ice pack, or loose ice that is held submerged within the first fluid reservoir 20*a* optionally in a lower region thereof, for example at a depth of one third or more of a total depth of the first fluid reservoir 20*a*. The cooling element may comprise an electric cooling element operable to cool liquid in the first fluid reservoir 20*a*. The cooling element may be operable to freeze fluid in the first fluid reservoir 20*a* to form a frozen body. Fluid in thermal communication with the frozen body may be cooled thereby below the critical temperature.

In some embodiments, the apparatus 1 may be operable to open and close the gap 30. For example, after initial start up of the apparatus 1, when fluid in the first and second fluid reservoirs 20*a*, 20*b* has cooled sufficiently, the gap 30 may be closed. The gap 30 may be closed by movement of the wall 22 downwardly in the case that the gap 30 is provided between the wall 22 and a basal surface of the casing 10 or a basal wall as described above. In the case that one or more slits or apertures are provided in the wall 22, the slits or apertures may be opened and closed by means of a shutter arrangement. Other arrangements are also useful.

In some embodiments, gap 30 may be established (opened) in order to prolong useful cooling following loss of power to a cooling element 28 or other cooling means, for example due to melting of ice in an ice pack. Thus, fluid at the critical temperature in the lower region of the first reservoir 20*a* may receive thermal energy from warmer fluid in the second fluid reservoir 20*b*, cooling the fluid in the second reservoir 20*b*. Other arrangements are also useful.

FIG. 12 shows apparatus 50 according to an embodiment of the invention in the form of a liquid-filled liner 50. The liner 50 is arranged to be provided within an insulated container and to cool one or more objects within the container.

The liner 50 shown in FIG. 12 is substantially C shaped in plan view. It includes a first portion 52 having first and second fluid reservoirs 20*a*, 20*b* (not shown) separated by a wall 22 (not shown) in a similar manner to the arrangement of FIG. 2. The second fluid reservoir 20*b* is in thermal (and in some embodiments also fluid) communication with two fluid-filled cheek portions 54, 56 which project laterally from opposed ends of the first portion 52. The first portion 52 is substantially the same height as the cheek portions 54, 56 in the embodiment of FIG. 12 although other arrangements are also useful.

In use, the liner 50 is filled with fluid such that the first and second fluid reservoirs 20*a*, 20*b* and the cheek portions 54, 56 are filled to a sufficiently high level. Fluid in the first reservoir 20*a* is then cooled by a cooling element 28 which may for example be in the form of an electric cooling element 28 or a body of frozen liquid as described above. The cooling element 28 cools liquid in the first fluid reservoir 20*a* below the critical temperature. As in the case of the embodiments described above, fluid in the first reservoir 20*a* that is cooled by the cooling element 28 below the critical temperature is displaced upwardly by the sinking of fluid at the critical temperature and meets and mixes with warmer fluid, for example at approximately 10° C., disposed in the upper region of the second fluid reservoir 20*b*. A transfer of heat from the warmer fluid to the colder fluid thus occurs within mixing region 26 (FIG. 2), causing the colder fluid from the first fluid reservoir 20*a* and the warmer fluid from the second fluid reservoir 20*b* to increase and decrease in temperature, respectively, towards the critical temperature. Since fluid in the second fluid reservoir in the first portion 52 of the liner 50 is in thermal communication with fluid in the cheek portions 54, 56, cooling of the fluid in the cheek portions takes place.

The embodiment of FIG. 12 in which cheek portions 54, 56 are provided in addition to the first portion have the advantage that apparatus 50 with a larger surface area may be provided compared with apparatus not having cheek portions, such as the apparatus 1 of FIG. 2.

Furthermore, provision of apparatus 50 in the form of a liner 50 allows the possibility of converting any suitable insulated container into a refrigeration apparatus by inserting the liner 50 into the apparatus. Embodiments of the present invention therefore permit a conventional refrigerator to be converted into a refrigeration apparatus according to an embodiment of the present invention by the introduction of a liner such as the liner 50 of FIG. 12 into the apparatus.

It is to be understood that liners 50 according to embodiments of the present invention may be provided having only one cheek portion 54, 56. A liner 50 may be provided in which the one or more cheek portions 54, 56 are of a different shape and/or size to the cheek portions 54, 56 of the embodiment of FIG. 12. In some embodiments, an apparatus is provided that is suitable for introduction into an insulated container, the apparatus being similar to the apparatus of FIG. 12 but not having one or more cheek portions 54, 56. The apparatus may be referred to as a 'retrofit' apparatus suitable for introduction into an insulated container such as a conventional refrigerator. In some embodiments a cooling element of the conventional refrigerator may be employed as the cooling element 28 of the first fluid reservoir 20*a*. Alternatively in some embodiments the cooling element of the conventional refrigerator may be employed to cool a cooling element 28 of the first fluid reservoir 20*a*. Other arrangements are also useful.

FIG. 13 is a front view of apparatus 1 according to an embodiment of the invention with a front portion of a casing of the apparatus removed whilst FIG. 14 is a side view of the apparatus with a side portion of the casing of the apparatus removed. The apparatus functions in a similar manner to the apparatus of FIG. 2. As in the case of each of the Figures, like features of respective embodiments are provided with like reference numerals.

The apparatus 1 of FIG. 13 and FIG. 14 differs from that described above in that the payload volume 12 is smaller, and is immersed within fluid in the second fluid reservoir 20*b*. Furthermore, receptacles 42 are provided, also immersed in fluid in the second fluid reservoir 20*b*, into which articles for storage may be placed.

A plurality of apertures 40 are provided in each of the side walls 10*a*, 10*b* of the casing 10 each defining an opening into a respective receptacle 42. In the embodiment shown, the receptacles are for holding a beverage container such as a bottle or carbonated drinks can 44. In the illustrated embodiment, twenty receptacles 42 are provided, each side wall 10*a*, 10*b* comprising ten apertures 40 in two horizontal rows of five. The receptacles are disposed approximately at a mid height within the casing 10, between the payload container 12 and an upper wall 10*c* of the container 10.

Each receptacle 42 comprises an inwardly-directed, closed ended tube, sock or pouch 46 which, in the illustrated embodiment, is formed from a flexible or elastomeric material such as rubber and takes the shape of a cone, being narrower at its closed end than at the end adjacent to the opening 40.

Each pouch 46 is sized such that insertion of a beverage container 44 therein causes the elastomeric material to stretch around the body of the container. This permits the container 44 to be gripped securely by the pouch 46, preventing it from falling out during use or transportation. In addition, the surface area of the pouch 46 in physical contact with the container 44 is increased, thereby improving or optimising thermal transfer between the fluid in the second reservoir 20*b* and the container 44.

In order to prevent pressure from the fluid in the second reservoir 20*b* causing the pouch 46 to collapse or prolapse through the opening 40, opposing pouches 46 are attached to each other at their closed ends. In an alternative embodiment (not shown), the closed end of each pouch 46 is attached or pinned to the inner surface of the opposing wall of the container 10. Other arrangements are also useful.

Instead of using tapered pouches as illustrated, any other suitable shape may be employed including non-tapering tubular shaped pouches. In some embodiments the tubes may be formed from a stiff material having a wall of sufficiently low thermal resistance to allow efficient cooling of articles placed therein. In some embodiments, the apparatus may be arranged to allow articles to be inserted into a tube at one end and dispensed from the other end. Other arrangements are also useful.

FIG. 15 is a front view of apparatus 1 according to a further embodiment of the invention with a front portion of a casing 10 of the apparatus removed and FIG. 16 is a side view of the apparatus 1 with a side portion of the casing 10 removed. The apparatus is similar to that of FIGS. 13 and 14 except that the pouches 46 have been replaced by heat exchanger means in the form of a tube 42 disposed within the second reservoir 20*b*. The tube 42 extends between first and second apertures 40*a*, 40*b* formed in the side walls 10, 10*b* of the casing 10. One of the apertures 40*a* defines an inlet for fluid flowing into the heat exchanger tube 42 while the other aperture 40*b* defines an outlet for the fluid.

In the illustrated embodiment, the main portion of the tube 42 is helical in shape, having a number of coils so as to maximise the length of the tube that is immersed in the second reservoir 20*b* without significantly increasing packaging volume which could reduce the available space for the payload container 12.

The apertures 40 defining each end of the heat exchanger tube 42 may be formed in the same side 10*a* of the casing, as shown in the Figures, or may be formed in adjacent or opposite sides. A plurality of heat exchangers may be provided in the apparatus 1, depending on available space. The heat exchanger tube 42 is disposed approximately at a mid height within the casing 10, between the payload container 12 and an upper wall 10*c* of the casing 10.

The tube 42 of the heat exchanger may be formed from any suitable material. However, a material having a high thermal conductivity is preferred to optimise heat transfer between the fluid passing through the tube 42 and fluid within the second reservoir 20*b*. In one embodiment, for example, the tube 42 is formed from a metal material such as copper, stainless steel or any other suitable material.

In use, fluid to be cooled, such as water or a carbonated or still beverage, can be delivered from a storage container, such as a bottle or barrel, into the heat exchanger tube 42 through the inlet 40*a* by means of a compressor or fluid pump or by gravity feeding. Heat from the fluid in the tube 42 is transferred into the surrounding cold water contained in the second reservoir 20*b* of the apparatus 1 by means of thermal conduction through the wall of the tube 42 such that its temperature is reduced. The cooled fluid is then expelled through the outlet 40*b* for delivery to a suitable drinks dispensing apparatus.

The temperature of the fluid exiting the outlet 40*b* is therefore dependent on the temperature of the water surrounding the tube 42, the length of the tube 42 and the transit time of the fluid between the inlet 40*a* and the outlet 40*b*. In some embodiments the location of the tube 42 within the second fluid reservoir 20*b* may be set so as to provide a desired temperature of dispensed liquid for a given flow rate of liquid through the tube 42.

Embodiments of the invention are also suitable for providing a flow of cooled (or chilled) gas such as air. The cooled gas may be used to cool an environment such as a building, an article or for any other suitable cooling application.

FIG. 17 illustrates the variance of battery life (abscissa) with battery temperature over time. According to the Arrhenius equation, battery life generally decays exponentially with temperature increase and a general rule of thumb is that the lifetime of the battery reduces by 50% for each 10° C. increase in battery temperature.

It can thus be seen from FIG. 17 that the lifetime of a battery operating at a temperature of 35° C. (line 35) is approximately half that of a battery operating at a temperature of 25° C. (line 25) and approximately 25% that of a battery operating at a temperature of 15° C. (line 15).

It will be understood that battery operating temperature is dependent on both ambient temperature and current draw from the battery which also has a heating effect on the battery, and thus the temperature of an operating battery in an ambient temperature of 15° C. may be similar to, or even higher than, that of a quiescent battery in an ambient temperature of 35° C. Thus, the operation of batteries for extended periods in high ambient temperatures can reduce the lifetime of the batteries by over 75%, requiring regular replacement. However, the cost and logistics of replacing batteries may be prohibitive in underdeveloped countries or geographically remote areas.

Referring next to FIG. 18, an apparatus embodying one form of the invention is shown, in schematic form, generally at 100. The apparatus 100 is intended for cooling one or more batteries but the apparatus 100 is also suitable for cooling other articles. In the illustrated embodiment, the apparatus 100 is arranged to cool a single battery 40. Herein, the term "battery" is used to encompass either a single battery or cell, or a plurality of cells collectively forming a battery. Embodiments of the present invention may be used to cool each of a plurality of cells, or a single battery comprising such a plurality.

The apparatus 100 comprises a cooling unit 1 similar to that illustrated in FIG. 2 except that the unit 1 is not provided with a payload compartment 12. Instead, the second fluid reservoir 20*b* is in fluid communication with a heat exchanger 51 of a cooler module 50 by means of a fluid conduit 18. The conduit 18 is sized to have a sufficiently large cross-sectional area for the particular application and operating conditions.

In the illustrated embodiment, the fluid in the first and second fluid reservoirs 20*a* (not shown) and 20*b* is mostly water although other fluids are also useful. As for each embodiment described herein, the reservoirs 20*a*, 20*b* are preferably not completely filled with fluid so as to permit expansion of the fluid volume due to temperature changes during use. A valve may be provided to permit a pressure of any gas in the casing 10 above the level of fluid in the reservoirs 20*a*, 20*b* to remain substantially in equilibrium with atmosphere.

As noted above, a fluid conduit or pipe 18 connects the bottom of the second fluid reservoir 20*b* to a heat exchanger 51 such that the heat exchanger 51 and the reservoir 20*b* are in fluid communication. That is to say, the reservoir 20*b* and the heat exchanger 51 form a single, contiguous fluid chamber.

The heat exchanger 51 comprises a thin-walled, cuboidal container having a relatively high surface area-to-volume ratio. In the illustrated embodiment, the heat exchanger 51 is rectangular in shape having a height and width that is significantly greater than its depth. Conveniently, though not essentially, the heat exchanger 51 generally corresponds in size and surface area to the shape of the battery 40 to be cooled.

Nevertheless, the heat exchanger 51 may take substantially any shape according to the desired application, although high surface area-to-volume ratio arrangements may optimise heat transfer between the fluid therein and the battery 40. The heat exchanger 51 is conveniently formed from a material having a high thermal conductivity or transmissivity such as a metal material, again to improve heat transfer. Although not shown in the drawings, the heat exchanger 51 is perforated, having apertures extending therethrough from one radiating surface to the other, the purpose of which is described below.

The heat exchanger 51 is disposed in a housing 55 such that it is positioned, in a generally upright orientation, close to or adjacent the battery 40 to be cooled. The housing 55 has an air inlet 56 in fluid communication with a fan or compressor 60 via a ducting 58. The fan or compressor 60 is arranged to draw in ambient air and pump it into the housing 55 via the ducting 58 and the inlet 56.

As shown in FIG. 19, the housing 55 features a plurality of exchange conduits 52 that pass through the heat exchanger 51 between opposed walls thereof. Apertures are provided in the opposed walls allowing air flowing through the conduit 58 to flow through the heat exchanger via the plurality of exchange conduits 52. Air that has passed through the conduits 52 is subsequently directed to flow over the battery 40. In other words, air drawn into the ducting 58 by the fan or compressor 60 flows into the housing 55 via the inlet 56 and passes through the exchange conduits 52 towards the battery 40. In passing through the housing 55, some of the air flows around the heat exchanger 51 whilst a majority of the air flows through the exchange conduits 52 formed therein. A diameter of the apertures in the opposed walls of the heat exchanger 51 are relatively small in size such that the air expelled therethrough takes the form of a plurality of fine air jets which are directed at the external surface of the battery 40. The apertures may be of smaller diameter than the exchange conduits in order to increase a residence time of gas within the conduits 52, allowing a further reduction in temperature of gas passing through the conduits 52.

Operation of the apparatus of FIG. 18 will now be described.

As discussed above, fluid in the second fluid reservoir 20*b* may be maintained at around the critical temperature of the fluid due to the maxima in fluid density as a function of temperature at the critical temperature. If fluid in the heat exchanger 55 is at a temperature above that of fluid in the second fluid reservoir 20*b*, fluid in the second fluid reservoir 20*b* will sink under gravity through the conduit 18 forcing fluid in the heat exchanger 55 to rise.

It is to be understood that a convection current may be established within the fluid volume defined by the second fluid reservoir 20*b* and heat exchanger 55 whereby the cooled fluid (e.g. water) sinks from the reservoir 20*b* through the fluid conduit 18 into the heat exchanger 55 so displacing the warmer (and thus less dense) fluid below. This warmer water rises into the reservoir 20*b* through the conduit 18 and is, in turn, cooled in the thermal transfer region 26 (FIG. 2). The temperature of fluid in the second reservoir 20*b* rises due to the warmer fluid entering the reservoir 20*b*. Eventually, the rate of convection decreases, causing the fluid within the heat exchanger 51 to become comparatively stagnant at a temperature lower than that which would otherwise be achieved if the heat exchanger 51 were not in fluid communication with the fluid in the second reservoir 20*b*.

The arrangement of FIG. 18 enables heat from the battery 40 to be absorbed by the cooled gas flowing over it, thereby lowering the temperature of the battery 40. Hence, a battery 40 subject to high ambient temperatures can be simply and efficiently cooled, allowing it to be maintained at a lower temperature and mitigating the adverse effects of high ambient temperatures on battery life It will be understood that heat absorbed from the flow of ambient air through the heat exchange conduits 52 raises the temperature of the fluid therein. In some embodiments and in some arrangements the heat absorbed by the fluid in the heat exchanger 51 may be transferred to the fluid above (in the second fluid reservoir 20*b*) in one of two ways, depending on the temperature gradient within the fluid volume.

Taking water as an example fluid, if the temperature of the water in the system is substantially uniform at approximately 4° C., the increase in temperature of the water in the heat exchanger 51 decreases its density relative to the water above. A convection current is thus established whereby the warmer and therefore less dense water in the heat exchanger 51 is displaced by the cooler water above. The warmer water rises towards the reservoir 20*b* where it is cooled again in the second fluid reservoir 20*b* and/or thermal transfer region 26 and then sinks back down into the heat exchanger 51. Thus, heat is transferred from the heat exchanger 51 to the reservoir 20*b* primarily by convection in this way.

Whilst power to the electrically powered cooling element 28 is maintained and the fan or compressor 60 still operate, this recirculation within the water volume defined by the reservoir 20*b* and heat exchanger 51 may continue indefinitely, advantageously maintaining the battery 40 at a lower than ambient temperature and thereby prolonging its usable life.

On the other hand, if the temperature of the water in the thermal transfer region 26 is sufficiently lower than that of the water in the heat exchanger 51, the density of the water in the heat exchanger 51 may remain greater than that of the water in the thermal transfer region 26, despite the increase in temperature due to flow of gas through the exchange conduits 52. Thus the water in the heat exchanger 51 tends to remain in the heat exchanger 51 and no circulation of water is established.

In some embodiments, heat absorbed by the water in the heat exchanger 51 is transferred to the colder water in the reservoir 20*b* primarily by conduction. The rate of heat transfer may depends on the temperature differential between the heat exchanger 51 and the reservoir 20*b*.

Again, whilst supply of power is maintained to the cooling element 28 and the fan or compressor 60, a relatively large negative temperature differential may be maintained between the water in the heat exchanger 51 and the water in the reservoir 20*b*. Thus, heat transfer from the heat exchanger 51 may continue indefinitely, advantageously maintaining the battery 40 at a lower than ambient temperature and thereby prolonging its usable life.

Even in the event that the power from the external power supply 16 fails, for example during a rolling blackout or following an unexpected event, such that power is no longer supplied to the cooling element 28, the apparatus 10 is able to provide a temporary cooling effect on the battery 40. In the case of apparatus employing a phase change fluid such as water which freezes in the region of the cooling element 28, it may take several hours for the frozen fluid to melt, during which period cooling of fluid in the first (and therefore second) fluid reservoirs 20*a*, 20*b* continues. Due to the high specific heat capacity of water, the volume of water in the apparatus 10 is able to absorb a large amount of heat from the ambient air flowing across it without a significant increase in temperature.

By way of example, a system containing 1000 litres of water at an average of 4° C. would require absorption of approximately 130 MJ of heat from the air flowing across it before its temperature reached 35° C. Where the temperature of fluid in the second fluid reservoir 20*b* was lower than 4° C. at the point that power to the cooling elements 14 was cut, the amount of energy able to be absorbed would increase.

It will be appreciated that embodiments of the present invention provide a simple yet effective method and apparatus for cooling one or more articles such as one or more batteries. During periods in which mains or other external electrical power is available, embodiments of the invention may cool the batteries significantly below ambient temperature, thereby maintaining their usable life. Following loss of external electrical power, embodiments of the invention are able to maintain a cooling effect on the batteries so as to reduce their rate of temperature increase and thus at least partially mitigate the adverse effect of temperature on the batteries' useable life.

Some embodiments of the present invention are arranged to effect a relatively slow and/or gentle heat transfer process primarily by thermal conduction through the fluid but which, at start up of the system, may be effected more rapidly so as to lower the temperature of fluid in the heat exchanger to working temperature more quickly, by means of thermally-induced convection currents within the fluid volume.

The above described embodiment represents one advantageous form of the invention but is provided by way of example only and is not intended to be limiting. In this respect, it is envisaged that various modifications and/or improvements may be made to embodiments of the invention within the scope of the appended claims.

For example, while the apparatus 100 of FIG. 18 is shown cooling a single battery 40, the apparatus 100 may equally be used to cool a plurality of batteries, as shown in FIG. 20. In this embodiment, a second housing 55*b* and heat exchanger 51*b* are provided adjacent the second battery 40*b* and the ducting 58 is extended so as to communicate therewith. Likewise, a second fluid conduit 18*b* is provided between the reservoir 20*b* and the second heat exchanger 51*b*. Where further batteries are to be cooled by the apparatus 100, these features are duplicated as necessary. It will be appreciated that as the number of batteries to be cooled increases, it may be necessary to increase the size of the reservoir 20*b* so as to increase the thermal capacity of the system.

In an embodiment (not shown), the or each heat exchanger 51 may communicate with the reservoir 20*b* by dual fluid conduits 18 so as to facilitate recirculation of water within the system. Each fluid conduit 18 in the pair may open into the respective heat exchanger 20 at spaced apart locations, for example at opposite ends thereof in the manner of a conventional convection radiator. Other arrangements are also useful.

The number and size of the apertures 30 (and exchange conduits 52) in the housing 55 can be selected as desired. It is, however, considered that the provision of a plurality of small diameter holes producing an array of fine air jets may assist penetration of the boundary layer on the surface of the battery 40 and thus facilitate heat transfer away from the battery 40. However, the location of the or each heat exchanger 51 in a housing 55 is itself not essential and the heat exchanger 51 may simply be positioned close to or adjacent the battery 40, or may be mounted directly thereto.

It is also envisaged that where the heat exchanger 51 is mounted in physical contact with the battery 40, this may provide a sufficient cooling effect without the need for a flow of air therethrough. In this case, the fan 60, ducting 58 and housing 55 can be eliminated from the system.

Where a fan or compressor 60 is provided, this may be a low power device arranged to be supplied with power from an external power supply or, if the external power supply fails, from the battery 40 itself. The use of photovoltaic cells to supply power to the fan or compressor 60 is considered particularly advantageous.

Likewise, the cooling element 28 may be supplied with power from photovoltaic cells. In such an arrangement, loss of electrical power due to a reduction in available solar energy generally coincides with periods of darkness or poor weather conditions when the ambient temperature is lower and thus the requirement to cool the batteries is reduced.

It is not essential that the reservoir 20*b* and the heat exchanger 51 form a single, continuous volume. In one embodiment, a heat exchanger may be provided for exchanging heat between fluid in the reservoir 20*b* and fluid in the conduit 18. Thus at least two separate fluid bodies may be provided, one comprising fluid in the reservoir 20*b* and one comprising fluid in the conduit and heat exchanger 51. Other arrangements are also useful. For example in addition or instead fluid in the conduit 18 may be in fluid isolation from but in thermal communication with fluid in the heat exchanger 51.

In the embodiment of FIG. 19, an adjustable restrictor valve V is provided at a junction between the second fluid reservoir 20*b* and conduit 18. The valve V is operable to reduce a cross-sectional area of a path from the reservoir 20*b* into the conduit 18. This feature allows a temperature of fluid in the heat exchanger 51 to be controlled. The valve V may in some embodiments be controlled by an actuator in dependence on the temperature of fluid in the heat exchanger, fluid in the reservoir 20*b* or in dependence on any other suitable temperature such as an ambient air temperature. Instead of a valve V (such as a butterfly valve, gate valve or any other suitable valve V) the cross-sectional area of a path through the conduit 18 may be varied, for example by stretching the conduit 18 to reduce its cross-sectional area, by compressing the conduit 18 or by any other suitable method.

FIG. 21 shows apparatus according to a still further embodiment of the present invention in which the conduit 18 is not required. In the embodiment of FIG. 21, the second fluid reservoir 20*b* is provided with a plurality of exchange conduits 52 passing directly therethrough from one side to the other. In a similar manner to the embodiment of FIG. 20, a fan, blower or compressor 60 is arranged to force gas such as ambient air through a conduit 58 that is in fluid communication with the exchange conduits 52. Air that has passed through the exchange conduits 52 is directed to flow over the article to be cooled, in the present example a battery 40.

In the embodiment of FIG. 21 the wall forming the weir means 22 is hollow, and defines a portion of the conduit 58 between the fan 60 and exchange conduits 52. In some embodiments, a portion of the wall 22 facing the first fluid reservoir 20*a* is provided with a layer of insulation 221. This reduces transfer of thermal energy between gas passing through the hollow wall 22 and fluid in the first fluid reservoir 20*a*.

In the arrangement of FIG. 21 the exchange conduits 52 are shown passing through the second fluid reservoir 20*b* in a direction away from the first fluid reservoir 20*a* and towards (and through) a rear wall 10*d* of the reservoir 20*b*. In some alternative embodiments, in addition or instead the exchange conduits 52 may pass through the second fluid reservoir 20*b* via (through) left and right sidewalls 10*a*, 10*b* (indicated in the embodiment of FIG. 13). The exchange conduits 52 may in some embodiments pass through the second fluid reservoir 20*b* in a direction substantially orthogonal to that of the exchange conduits 52 of the embodiment of FIG. 21.

It is to be understood that in embodiments of the present invention described herein, the temperature at which fluid (such as water) in the system has the highest density may be varied by means of an additive, such as a salt. For example the addition of a salt such as sodium chloride or potassium chloride may lower the temperature at which a fluid such as water is at its highest density. Other fluids that exhibit a negative thermal expansion coefficient (i.e. a decrease in density with decreasing temperature) below a certain critical temperature and a positive thermal expansion coefficient above that critical temperature may also be useful.

The above described embodiments represent advantageous forms of embodiments of the invention but are provided by way of example only and are not intended to be limiting. In this respect, it is envisaged that various modifications and/or improvements may be made to the invention within the scope of the appended claims.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. An apparatus, comprising:

a first fluid reservoir and a second fluid reservoir, the first and second fluid reservoirs defined by a weir and respective portions of a thermal transfer region, wherein the weir divides said first and second fluid reservoirs and extends from a base surface of the first and second reservoirs towards an upper wall of the first and second reservoirs while the apparatus is in an upright configuration, the first reservoir and the second fluid reservoir configured to be fully filled with a transmission liquid;

the thermal transfer region disposed between respective upper regions of the first and second fluid reservoirs, the thermal transfer region configured to enable continuous thermal transmission between the first fluid reservoir and the second fluid reservoir via the transmission liquid;

a cooling element disposed in a region associated with the transmission liquid at a highest density contained in the first fluid reservoir; and a payload container external to the second fluid reservoir and sharing a thermally conductive sidewall with the second fluid reservoir.

2. The apparatus of claim 1, wherein an upper end of the weir is spaced from the upper wall of the container so as to define an opening therebetween.

3. The apparatus of claim 1, wherein the weir extends between upper and lower walls of the container, and wherein the weir includes one or more apertures or slots provided in an upper region thereof.

4. The apparatus of claim 1, wherein one or both of the first and second fluid reservoirs is arranged to contain a type of transmission fluid having a negative temperature coefficient of thermal expansion below a critical temperature and a positive temperature coefficient of thermal expansion above the critical temperature.

5. The apparatus of claim 1, wherein the transmission liquid includes a first transmission liquid and a second transmission liquid, wherein the first transmission liquid fills the first fluid reservoir and the second transmission liquid fills the second fluid reservoirs.

6. The apparatus of claim 1, wherein the transmission liquid comprises water or a liquid having a set of thermal properties corresponding to water.

7. The apparatus of claim 1, wherein the cooling element is arranged to cool the fluid in the first fluid reservoir to a temperature below a critical temperature thereof.

8. The apparatus of claim 1, wherein the fluid within the first fluid reservoir at a temperature above or below a critical temperature is displaced towards the upper region of the first fluid reservoir by fluid at the critical temperature.

9. The apparatus of claim 7, wherein the fluid within the first fluid reservoir at a temperature below the critical temperature and displaced to the upper region of the first fluid reservoir undergoes thermal transfer in the thermal transfer region with an additional fluid from the second fluid reservoir at a temperature above the critical temperature.

10. The apparatus of claim 1, wherein the cooling element comprises a refrigeration unit or element arranged to cool the fluid within the first fluid reservoir.

11. The apparatus of claim 10, comprising a sensor operable to interrupt cooling by the cooling element upon detection that the fluid is below a prescribed temperature.

12. The apparatus of claim 10, comprising a sensor operable to interrupt cooling by the cooling element upon detection of a frozen fluid.

13. The apparatus of claim 1, wherein the cooling element comprises a thermal mass that, is at a temperature below a critical temperature of the fluid.

14. The apparatus of claim 13, wherein the thermal mass comprises a body of water ice.

15. The apparatus of claim 1, wherein the weir comprises any of:

a cylindrical wall, with the first fluid reservoir being defined within the cylindrical wall and the second fluid reservoir being defined outside the cylindrical wall; or a generally planar wall, with the first and second fluid reservoirs being disposed, respectively, on opposite sides of the planar wall in a side by side arrangement.

* * * * *